US011857010B2

(12) United States Patent
Schottenstein

(10) Patent No.: US 11,857,010 B2
(45) Date of Patent: Jan. 2, 2024

(54) CONFIGURABLE GARMENTS AND EARPOD HOLDERS

(71) Applicant: Edith Schottenstein, Surfside, FL (US)

(72) Inventor: Edith Schottenstein, Surfside, FL (US)

(73) Assignee: Swess, LLC, Wilmington, DE (US)

( * ) Notice: Subject to any disclaimer, the term of this patent is extended or adjusted under 35 U.S.C. 154(b) by 76 days.

(21) Appl. No.: 17/496,022

(22) Filed: Oct. 7, 2021

(65) Prior Publication Data

US 2022/0346477 A1 Nov. 3, 2022

Related U.S. Application Data

(60) Provisional application No. 63/208,548, filed on Jun. 9, 2021, provisional application No. 63/182,049, filed on Apr. 30, 2021.

(51) Int. Cl.
*A41D 27/20* (2006.01)
*A45F 5/02* (2006.01)

(52) U.S. Cl.
CPC ..... *A41D 27/205* (2013.01); *A45F 5/02* (2013.01); *A45F 2200/0508* (2013.01)

(58) Field of Classification Search
CPC ..... A41D 27/205; A41D 27/20; A41D 1/005; A41D 2200/20; A45F 5/02; A45F 2200/0508
See application file for complete search history.

(56) References Cited

U.S. PATENT DOCUMENTS 4,453,292 A * 6/1984 Bakker ..... F16G 11/101 24/115 G
6,948,218 B1 9/2005 Donze
7,519,192 B1 4/2009 Laycock et al.
8,625,835 B2 * 1/2014 Gotlieb ..... H04R 1/1033 2/209
8,687,834 B2 * 4/2014 Wolfe ..... H04R 1/028 381/384

(Continued)

OTHER PUBLICATIONS

Amazon.com, Inc., "innoGadgets Strap for Apple AirPods | Smart Accessory—Never Lose Your AirPod | Connector Wire Cable Cord for AirPods | White—22 inches," retrieved at https://www.amazon.com/strap-apple-airpods-innogadgets-accessory/dp/B07H1DFHJD on Oct. 7, 2021.

(Continued)

*Primary Examiner* — David M Upchurch
(74) *Attorney, Agent, or Firm* — Hartman & Citrin LLC

(57) ABSTRACT

An earpod holder for a configurable garment can include a button portion having a button surface that is connected to a button guide surface. The button guide surface can include a button aperture that can pass through the button guide surface and a button retention slot that can be formed on the button guide surface. The earpod holder further can include a body portion having sidewalls that can surround a body portion void that can be configured to accept the button guide surface. The body portion can include a front body portion aperture that passes through a front side of the sidewalls into the body portion void and a rear body aperture that can pass through a rear side of the sidewalls into the body portion void. The earpod holder further can include a sleeve retainer that can be configured to engage a sleeve that can hold an earpod.

20 Claims, 17 Drawing Sheets

(56) References Cited

U.S. PATENT DOCUMENTS

| | | | | |
|---|---|---|---|---|
| 9,088,848 | B2 * | 7/2015 | Abreu | H04M 1/05 |
| 9,339,064 | B2 * | 5/2016 | Oliver | A41D 1/04 |
| 9,949,509 | B2 * | 4/2018 | Oliver | A42B 1/048 |
| 10,512,304 | B2 * | 12/2019 | Nussbaum | A43C 7/08 |
| 11,357,280 | B2 * | 6/2022 | Sanchez | A42B 3/0406 |
| 2009/0173455 | A1 * | 7/2009 | Hartley | A45F 5/02 160/127 |
| 2009/0245931 | A1 * | 10/2009 | Stiehl | A45F 5/00 403/322.2 |
| 2010/0329499 | A1 | 12/2010 | Wolfe | |
| 2012/0132556 | A1 | 5/2012 | Webster | |
| 2017/0150772 | A1 * | 6/2017 | Nussbaum | A43B 3/34 |
| 2018/0250168 | A1 * | 9/2018 | Herring | H04R 5/033 |
| 2019/0364988 | A1 * | 12/2019 | Driessen | A61F 11/08 |
| 2020/0305521 | A1 * | 10/2020 | Elliott | A41D 3/00 |
| 2021/0204627 | A1 * | 7/2021 | Linchitz | A41D 3/005 |

OTHER PUBLICATIONS

International Search Report and Written Opinion dated Feb. 4, 2022, issued in International Application No. PCT/US2021/059450.

* cited by examiner

CONFIGURABLE GARMENTS AND EARPOD HOLDERS

CROSS-REFERENCE TO RELATED APPLICATIONS

This application claims the benefit of U.S. Provisional Patent Application No. 63/182,049, entitled "Configurable Garment," filed Apr. 30, 2021, which is incorporated herein by reference in its entirety. This application also claims the benefit of U.S. Provisional Patent Application No. 63/208,548, entitled "Earpod Holder for a Configurable Garment," filed Jun. 9, 2021, which is incorporated herein by reference in its entirety.

TECHNICAL FIELD

The present disclosure relates generally to garments and garment technologies. More particularly, the present disclosure relates to configurable garments, earpod holders, and various components of configurable garments and earpod holders.

BACKGROUND

Unless otherwise indicated herein, all disclosures in the background are not prior art to the claims in this application and are not admitted to be prior art by inclusion in this section.

Earpods and other listening devices are popular accessories for various electronic devices such as computers, media players, cellular phones, etc. Years ago, earbuds or other listening devices were generally wired devices that were plugged into the device during use. Over the years, however, improved battery life and efficiency, along with other advances in various technologies, have resulted in wireless listening devices that can be charged and used for hours without any wires.

SUMMARY

The present disclosure is directed to configurable garments and earpod holders. A configurable garment can include removable pockets, a removable hood, and one or more earpod holders that can be attached to one or more drawstrings of the configurable garment. According to some embodiments of the concepts and technologies disclosed herein, the earpod holders can include a body portion, a button portion, and a sleeve. The button portion and body portion can include apertures that can cooperate to form a passageway for accommodating and engaging a drawstring. A sleeve attached to the body portion can be configured to engage an earpod to prevent the dropping of and/or loss of the earpod. These and other aspects of the concepts and technologies disclosed herein will be illustrated and described in more detail herein.

According to one embodiment of the concepts and technologies disclosed herein, an earpod holder is disclosed. The earpod holder can include a button portion having a button surface that can be connected to a button guide surface. The button guide surface can include a button aperture that can pass through the button guide surface and a button retention slot formed on the button guide surface. The earpod holder further can include a body portion having sidewalls that surround a body portion void that can be configured to accept the button guide surface. The body portion can include a front body portion aperture that can pass through a front side of the sidewalls and into the body portion void and a rear body portion aperture that can pass through a rear side of the sidewalls and into the body portion void. The earpod holder further can include a sleeve retainer formed on an outer surface of the sidewalls of the body portion. The sleeve retainer can be configured to engage and retain a sleeve that can be configured to hold an earpod.

In some embodiments, the button portion can include a button spring retainer at a first end of the button portion. The button surface can be located at a second end of the button surface. In some embodiments, the body portion can include a body spring retainer that can be located within the body portion void. In some embodiments, the earpod holder further can include a spring. The button portion can include a button spring retainer at a first end of the button portion, the button surface can be located at a second end of the button surface, the body portion can include a body spring retainer that can be located within the body portion void, a first end of the spring can be attached to the button spring retainer, and a second end of the spring can be attached to the body spring retainer.

In some embodiments, the front body portion aperture can include a first button retention cutout that can be configured to accommodate the button retention slot. In some embodiments, the earpod holder further can include another button retention slot formed on the button guide surface. The rear body portion aperture can include a second button retention cutout. The button retention slot can engage the first button retention cutout, and the other button retention slot can engage the second button retention cutout. In some embodiments, the button portion further can include a sidewall engagement surface that can be configured to engage the sidewalls when pressure is applied to the button surfaces.

According to another embodiment of the concepts and technologies disclosed herein, an earpod holder is disclosed. The earpod holder can include a button portion having a button surface that can be connected to a button guide surface. The button guide surface can include a button aperture that can pass through the button guide surface and a button retention slot formed on the button guide surface. The earpod holder further can include a body portion having sidewalls that surround a body portion void that can be configured to accept the button guide surface. The body portion can include a front body portion aperture that can pass through a front side of the sidewalls and into the body portion void and a rear body portion aperture that can pass through a rear side of the sidewalls and into the body portion void. The earpod holder further can include a sleeve that can include a cylindrical tube of material. The earpod holder further can include a sleeve retainer formed on an outer surface of the sidewalls of the body portion. The sleeve retainer can be configured to engage the sleeve.

In some embodiments, the button portion can include a button spring retainer at a first end of the button portion. The button surface can be located at a second end of the button portion. In some embodiments, the body portion can include a body spring retainer that can be located within the body portion void. In some embodiments, the earpod holder further can include a spring, the button portion can include a button spring retainer at a first end of the button portion, the button portion can be located at a second end of the button portion, the body portion can include a body spring retainer that can be located within the body portion void, and the spring can be connected to the button spring retainer and the body spring retainer.

In some embodiments, the front body portion aperture can include a first button retention cutout that can be configured to accommodate the button retention slot. In some embodiments, the earpod holder further can include another button retention slot formed on the button guide surface. The rear body portion aperture can include a second button retention cutout. The button retention slot can engage the first button retention cutout, and the other button retention slot can engage the second button retention cutout. In some embodiments, the button portion further can include a sidewall engagement surface that can be configured to engage the sidewalls when pressure is applied to the button surfaces.

According to yet another embodiment of the concepts and technologies disclosed herein, an earpod holder is disclosed. The earpod holder further can include a button portion having a button surface that can be connected to a button guide surface. The button guide surface can include a button aperture that can pass through the button guide surface and a button retention slot that can be formed on the button guide surface. The earpod holder further can include a body portion having sidewalls that surround a body portion void that can be configured to accept the button guide surface. The body portion can include a front body portion aperture that can pass through a front side of the sidewalls and into the body portion void, and a rear body portion aperture that can pass through a rear side of the sidewalls and into the body portion void. The earpod holder further can include a spring that can be connected to the button portion and the body portion. The earpod holder further can include a sleeve that can include a cylindrical tube of material and a sleeve retainer formed on an outer surface of the sidewalls of the body portion. The sleeve retainer can be configured to engage the sleeve.

In some embodiments, the button portion can include a button spring retainer at a first end of the button portion. The button surface can be located at a second end of the button portion, and a first end of the spring can be connected to the button spring retainer. In some embodiments, the body portion can include a body spring retainer that can be located within the body portion void, and a second end of the spring can be connected to the body spring retainer. In some embodiments, the front body portion aperture can include a first button retention cutout that can be configured to accommodate the button retention slot.

In some embodiments, the earpod holder further can include another button retention slot formed on the button guide portion. The rear body portion aperture can include a second button retention cutout. The button retention slot can engage the first button retention cutout and the other button retention slot can engage the second button retention cutout. In some embodiments, the front body portion portion aperture, the rear body portion aperture, and the button aperture can be configured to cooperate when aligned to form a passageway. The passageway can be configured to accommodate and engage a drawstring.

DETAILED DESCRIPTION

Figure 1:
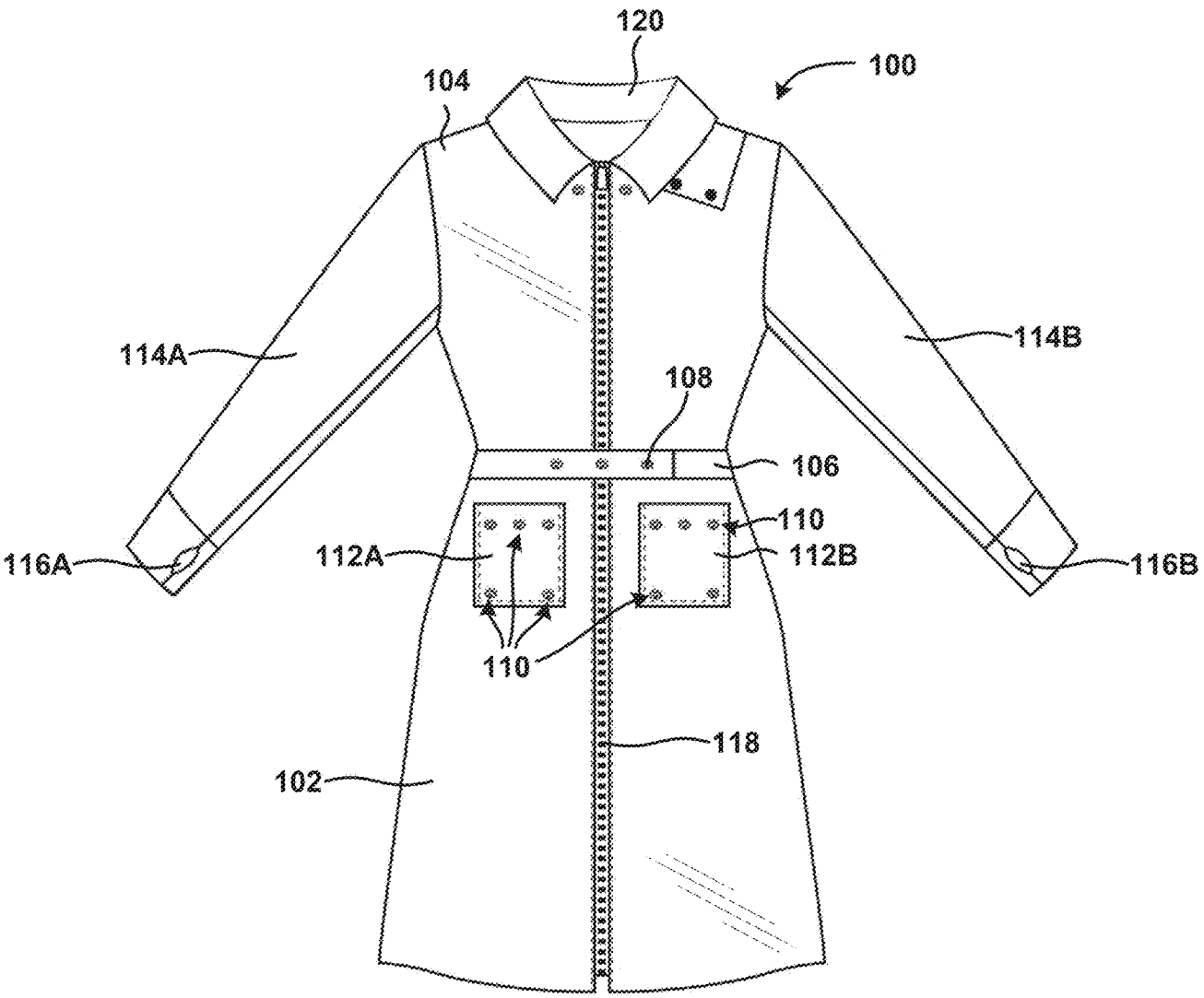
FIG. 1 is a line drawing illustrating a front view of a configurable garment, according to one illustrative embodiment of the concepts and technologies disclosed herein.

The present disclosure is directed to configurable garments and earpod holders. Some embodiments of the configurable garment illustrated and described herein can include a removable hood. In some embodiments of the concepts and technologies disclosed herein, the hood can be removed so that the configurable garment can be worn as a dress, for example, a casual workwear dress. The configurable garment and/or a removable hood thereof can include a collar and/or other structure that can include a drawstring passageway, hoops, loops, or the like, through which a drawstring can be passed. In various embodiments of the concepts and technologies disclosed herein, the drawstring can include an earpod holder for holding and/or securing earpods, wireless earpods, hearing aids, and/or other devices.

In some other embodiments, an earpod holder can be removably attached to the drawstring of the configurable garment and/or drawstrings, cords, ropes, laces, or the like of any kind (including other garments). The drawstring can be used to prevent loss and/or dropping of the earpods and/or other listening devices, in various embodiments. Thus, various features of the concepts and technologies disclosed herein can be used to make the configurable garment versatile and multifunctional. It should be understood that this example is illustrative, and therefore should not be construed as being limiting in any way.

In the following detailed description, references are made to the accompanying drawings that form a part hereof and that show, by way of illustration, specific embodiments or examples. It must be understood that the disclosed embodiments are merely illustrative of the concepts and technologies disclosed herein. The concepts and technologies disclosed herein may be embodied in various and alternative forms, and/or in various combinations of the embodiments disclosed herein. The word "illustrative," as used in the specification, is used expansively to refer to embodiments that serve as an illustration, specimen, model, sample, or pattern.

Additionally, it should be understood that the drawings are not necessarily to scale, and that some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure. Referring now to the drawings, in which like numerals represent like elements throughout the several figures, aspects of a configurable garment will be described.

Referring first to FIG. 1, a configurable garment 100 is illustrated, according to an illustrative embodiment of the concepts and technologies disclosed herein. In particular, FIG. 1 is a line drawing illustrating a front view of a configurable garment 100 according to one illustrative embodiment of the concepts and technologies disclosed herein. It should be understood that this example is illustrative, and therefore should not be construed as being limiting in any way.

The configurable garment 100 can include a skirt portion ("skirt") 102 and a bodice portion ("bodice") 104. In various embodiments of the concepts and technologies disclosed herein, the skirt 102 can be joined to the bodice 104 at a waistline (not visible in FIG. 1), while in various other embodiments, the skirt 102 and bodice 104 of the configurable garment 100 can be formed from the same piece(s) of material. In the illustrated embodiment, the skirt 102 and the bodice 104 are formed from the same piece of material and may be sewn together along a hem on one side of the configurable garment 100. In the illustrated embodiment, the hem is therefore not visible in FIG. 1. It should be understood that the illustrated embodiment is illustrative, and therefore should not be construed as being limiting in any way.

According to various embodiments of the concepts and technologies disclosed herein, a belt 106 can be included as part of the configurable garment 100 and/or may be used with the configurable garment 100. The belt 106 may be removable from the configurable garment 100 according to various embodiments. As illustrated in FIG. 1, the belt 106 is removable and can be configured to connect to itself by way of one or more snaps or other mechanical fasteners (e.g., snaps, buttons, VELCRO, magnets, etc.), where these fasteners can function as belt attachment mechanisms 108 (hereinafter referred to as "belt attachment mechanisms 108"). It should be understood that in some embodiments, attachment mechanisms may be attached to or formed as a part of the configurable garment 100, though in the illustrated embodiment of the configurable garment 100 shown in FIG. 1 does not include attachment mechanisms for the belt 106.

In the embodiment illustrated in FIG. 1, the functionality of the belt attachment mechanisms 108 can be provided by male snaps on an outside surface of one end of the belt 106 (as shown in FIG. 1), where the male snaps can be configured to engage female snaps that can be located on an inside surface of a second end of the belt 106 (not visible in FIG. 1). Because other structures and/or mechanisms can provide the functionality of the belt attachment mechanisms 108 in various embodiments of the concepts and technologies disclosed herein, it should be understood that the illustrated embodiment is illustrative, and therefore should not be construed as being limiting in any way.

In various embodiments of the concepts and technologies disclosed herein, as noted above, the configurable garment 100 can include loops, hoops, or other structures for retaining the belt 106, though such structures are not shown in FIG. 1 and are not included in various embodiments. The belt 106 can be configured to cover the waistline of the configurable garment 100 in some embodiments, or otherwise can be used to hold the configurable garment 100 in a particular configuration (e.g., to tighten the waist of the configurable garment 100 against the waist of the wearer) as is generally understood. Because the belt 106 can be omitted in some embodiments of the configurable garment 100, it should be understood that the illustrated embodiment is illustrative and should not be construed as being limiting in any way.

According to various embodiments of the concepts and technologies disclosed herein, embodiments of the configurable garment 100 can include one or more removable pockets (not visible in FIG. 1). In some embodiments, as will be illustrated below with reference to FIGS. 4-5, the removable pockets can include a zippered or otherwise selectively openable/closeable compartment, a retractable cord and/or carrying strap, and/or other features. These and other aspects of the removable pockets will be illustrated and described in more detail below with reference to FIGS. 4-5.

The removable pockets can be connected or attached to the configurable garment 100 via one or more snaps or other mechanical fasteners (e.g., snaps, buttons, VELCRO, magnets, etc.), which can function as pocket attachment or connector mechanisms (hereinafter referred to as "pocket connector snaps 110"). The pocket connector snaps 110 can be located on or at one or more pocket attachment areas 112A-B (hereinafter collectively and/or generically referred to as "pocket attachment areas 112") of the configurable garment 100.

In some embodiments of the concepts and technologies disclosed herein, the pocket attachment areas 112 can include a layer of canvas, denim, leather, plastic, and/or other materials. The pocket attachment areas 112 can be configured to reinforce and/or strengthen material used to form the configurable garment 100 at the location of the pocket attachment areas 112, or to add support for the removable pockets when attached to the pocket attachment areas 112. It should be understood that this example is illustrative, and therefore should not be construed as being limiting in any way. In the illustrated embodiment, the pocket attachment areas 112 can include a layer of material through which and/or to which the pocket connector snaps 110 are attached or connected, and the removable pockets can be connected to the configurable garment 100 via the pocket connector snaps 110. Thus, the pocket connector snaps 110 can be used to connect or attach the removable pocket to the configurable garment 100 in a non-permanent manner, thereby enabling a wearer or other entity to remove the removable pocket from the configurable garment 100 at will. It should be understood that this example is illustrative, and therefore should not be construed as being limiting in any way.

In various embodiments of the concepts and technologies disclosed herein, the configurable garment 100 can include sleeves 114A-B (hereinafter collectively and/or generically referred to as "sleeves 114"). As shown in FIG. 1, the sleeves 114 can be configured as long sleeves in various embodiments of the concepts and technologies disclosed herein, though some embodiments of the configurable garment 100 include sleeves 114 that can be configured as mid-length sleeves (e.g., sleeves that pass the elbow and end somewhere along the forearm of the wearer) or short sleeves (e.g., sleeves that end somewhere above the elbow). Still other embodiments of the configurable garment 100 may have no sleeves 114. As such, the illustrated embodiment is illustrative and should not be construed as being limiting in any way.

According to various embodiments of the concepts and technologies disclosed herein, the sleeves 114 also can be configured to include thumb openings 116A-B (hereinafter collectively and/or generically referred to as "thumb openings 116"). The thumb openings 116 can include apertures formed in the material of the sleeves 114 that allow the thumb of the wearer to pass through. According to various implementations of the thumb openings 116, the thumb openings 116 can be engaged by thumbs of the wearer to encourage ends of the sleeves 114 to stay at or near the wrist of the wearer. Thus, the thumb openings 116 can be used to enable a wearer to engage in various activities while maintaining the ends of the sleeves 114 at or near the wrist. Thus, some embodiments of the configurable garment 100 can be used by wearers who cover their arms for religious reasons, medical reasons, personal reasons, or the like, even during activities where the ends of the sleeves 114 may otherwise be difficult to keep past the wearer's elbows, or the like. It should be understood that this example is illustrative, and therefore should not be construed as being limiting in any way.

In some embodiments, as illustrated in FIG. 1, the configurable garment 100 can be configured to be selectively opened, for example using a zipper, buttons, snaps, or other mechanism (hereinafter referred to as a "zipper") 118. Because the function of the zipper 118 is generally known and understood, the zipper 118 and/or the purpose, structures, and/or functions thereof will not be further described herein in detail. The configurable garment 100 and/or a removable hood thereof also can include a collar 120 and/or other structure through which a drawstring (not illustrated in FIG. 1) can be passed or to which the drawstring can be connected. The purpose of the drawstring will be illustrated and described in more detail herein.

According to various embodiments of the concepts and technologies disclosed herein, the configurable garment 100 and/or one or more portions thereof (e.g., the skirt 102, the bodice 104, the belt 106, the pocket attachment areas 112, the sleeves 114, removable hoods, removable pockets, and/or other portions or components of the configurable garment 100) can be formed from a ponte material (e.g., a material made from knitted (e.g., double knitted) natural, synthetic, and/or blended fabric). According to various embodiments of the concepts and technologies disclosed herein, the ponte material can be formed from cotton, nylon, spandex, rayon, viscose, polyester, combinations thereof, or the like. In some embodiments, a lightweight ponte fabric may be preferred as it may provide a four-way stretchable fabric that is durable, sustainable, and machine washable. It should be understood that this example is illustrative, and therefore should not be construed as being limiting in any way.

In some other embodiments, the configurable garment 100 can be made from hemp and/or hemp-derived materials. In some other embodiments, the configurable garment 100 can be made from neoprene and/or a neoprene fabric. Some embodiments of the configurable garment 100 formed from neoprene can be used to provide a water-resistant version of the configurable garment 100, if desired. In some embodiments of a configurable garment 100 formed from a neoprene fabric, the configurable garment 100 can be worn in the rain, for swimming, and/or even for scuba diving. It should be understood that these examples are illustrative, and therefore should not be construed as being limiting in any way.

Figure 2:
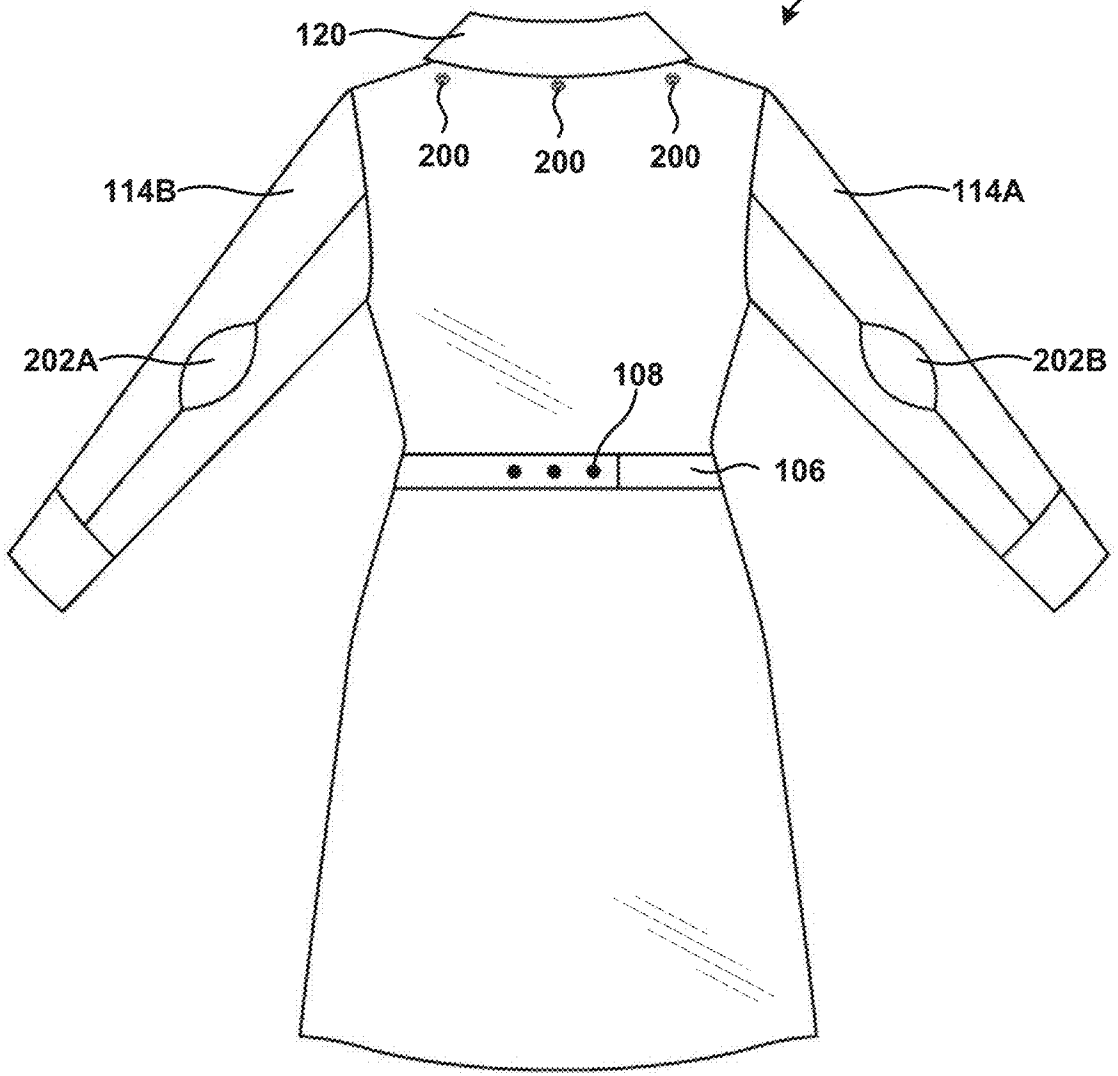
FIG. 2 is a line drawing illustrating a rear or back view of a configurable garment, according to one illustrative embodiment of the concepts and technologies disclosed herein.

Turning now to FIG. 2, additional aspects of the configurable garment 100 will be illustrated, according to an illustrative embodiment of the concepts and technologies disclosed herein. In particular, FIG. 2 shows a rear or back view of one embodiment of the configurable garment 100 as illustrated and described above with reference to FIG. 1. It should be understood that this example is illustrative, and therefore should not be construed as being limiting in any way.

As shown in FIG. 2, some embodiments of the concepts and technologies disclosed herein can include one or more snaps or other mechanical fasteners (e.g., snaps, buttons, VELCRO, magnets, etc.) that can function as hood attachment or connection mechanisms (hereinafter referred to as "hood connector snaps 200"). The hood connector snaps 200 can be located on, at, or near the collar 120 of the configurable garment 100, in various embodiments. According to various embodiments of the concepts and technologies disclosed herein, a removable hood (not illustrated in FIG. 2) can be attached to the configurable garment 100 via one or more of the hood connector snaps 200. It should be understood that this example is illustrative, and therefore should not be construed as being limiting in any way.

As shown in FIG. 2, the configurable garment 100 also can include one or more elbow stretch pads or patches ("stretch pads") 202A-B (hereinafter collectively and/or generically referred to as "stretch pads 202"). According to various embodiments of the concepts and technologies disclosed herein, the stretch pads 202 can be made from an elastic and/or stretchable material including one-way, two-way, and/or four-way stretchable materials such as knitted, braided, woven, and/or otherwise manufactured materials that can be made from natural materials, synthetics, and/or blends of natural and synthetic materials. Thus, various embodiment of the stretch pads 202 can be made from materials that can include cotton, wool, polyester, spandex, NYLON®, stretch velvet, stretch wool, stretch silk, and/or other materials and/or blends thereof. Because additional and/or alternative materials can be used to form the stretch pads 202, it should be understood that these example materials are illustrative, and therefore should not be construed as being limiting in any way.

According to various embodiments, the stretch pads 202 can be configured to allow a wearer to bend their arms without stretching fabric of the sleeves 114 and/or without experiencing resistance from the fabric of the sleeves 114. This may be useful as some embodiments of the configurable garment 100 illustrated and described herein can include thumb openings 116 as noted above, and therefore the sleeves 114 may be stretched during bending of the arms. The stretch pads 202 can be configured to reduce the amount of stretching experienced by the sleeves 114, in some embodiments. It should be understood that this potential benefit is not included in all embodiments, so this embodiment is illustrative and should not be construed as being limiting in any way. In some other embodiments, the stretch pads 202 can be replaced and/or supplemented with patches or materials (e.g., denim, canvas, etc.) that can be configured to reinforce the elbow portions of the sleeves 114 and/or for other reasons. It should be understood that this example is illustrative, and therefore should not be construed as being limiting in any way.

Figure 3:
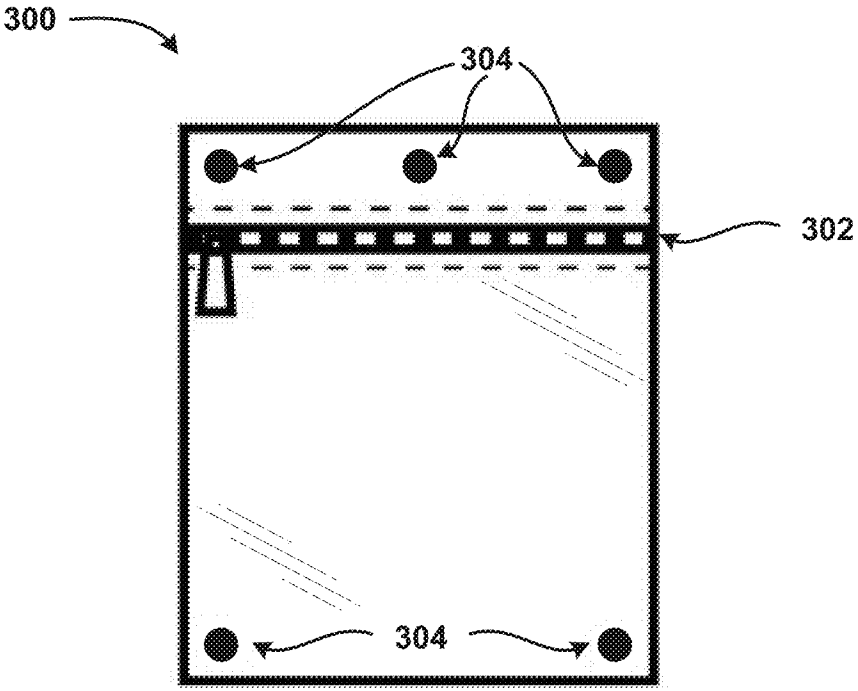
FIG. 3 is a line drawing illustrating a front view of a removable pocket for a configurable garment, according to one illustrative embodiment of the concepts and technologies disclosed herein.

Turning now to FIG. 3, an example of a removable pocket 300 that can be attached to, connected to, detached from, and/or disconnected from the configurable garment 100 will be illustrated and described in detail, according to an example embodiment of the concepts and technologies disclosed herein. In particular, FIG. 3 is a line drawing illustrating a front view of the removable pocket 300, according to one embodiment of the concepts and technologies disclosed herein.

As shown in FIG. 3, the removable pocket 300 can include a pocket, pouch, compartment, and/or other void (not labeled in FIG. 3), where the void can be selectively opened and/or closed by way of one or more snaps, buttons, magnets, VELCRO, zippers, and/or other mechanical device that can be used to seal the void. In the embodiment shown in FIG. 3, the functionality of the mechanical device that can be used to seal the void is provided by a zipper 302. This embodiment is only one contemplated embodiment of the concepts and technologies disclosed herein and therefore should not be construed as being limiting in any way.

According to various embodiments of the concepts and technologies disclosed herein, a wearer or other entity may have nothing in the removable pockets 300, or may put one or more than one article(s) into the removable pocket 300. The removable pocket 300 can be removed from the configurable garment 100 with article(s) in the pockets or the removable pocket 300 can be removed from the configurable garment 100 empty. In some embodiments, a wearer may put valuables and/or other materials into the removable pocket 300 and remove the removable pocket 300 from the configurable garment 100. For example, a wearer may put a phone or jewelry into the removable pocket 300 before exercising and may remove the removable pocket 300 during exercise to protect the phone or jewelry (e.g., by locking the removable pocket 300 into a locker or other secure location). In some other embodiments, the removable pocket 300 can be removed from one configurable garment 100 and attached to a different configurable garment 100, thereby obviating the need to empty articles out of the removable pocket 300. Because the removable pockets 300 can be removed and/or attached for additional and/or alternative reasons, it should be understood that the above examples are illustrative, and therefore these examples must not be construed as being limiting in any way.

Figure 4:
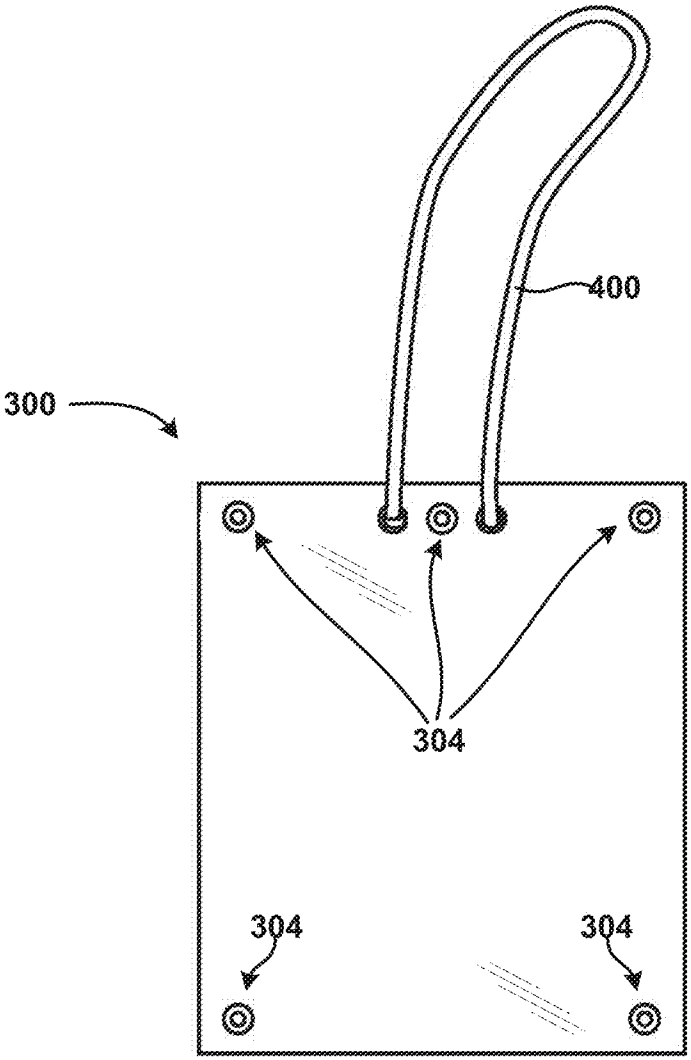
FIG. 4 is a line drawing illustrating a rear or back view of a removable pocket for a configurable garment, according to one illustrative embodiment of the concepts and technologies disclosed herein.

According to some embodiments of the concepts and technologies disclosed herein, the removable pocket 300 also can include one or more snaps, buttons, magnets, VELCRO, zippers, and/or other mechanical fasteners ("pocket snaps") 304. The pocket snaps 304 can pass through one or more layer of the removable pocket 300 in some embodiments and can project through the back of the removable pocket 300, as can be seen in FIG. 4 as described below. In some other embodiments, the pocket snaps 304 may be attached to an exterior of the removable pocket 300 and therefore may not be visible from the front view. Thus, the embodiment shown in FIG. 3 is illustrative and should not be construed as being limiting in any way.

The pocket snaps 304 can be used to connect the removable pocket 300 to the configurable garment 100, for example at the pocket connector snaps 110 of the pocket attachment areas 112. Because the pocket snaps 304 can be used to connect the removable pockets 300 to other locations on the configurable garment 100, it should be understood that this example is illustrative, and therefore should not be construed as being limiting in any way.

Turning now to FIG. 4, additional aspects of the removable pocket 300 will be illustrated in detail, according to an illustrative embodiment of the concepts and technologies disclosed herein. In particular, FIG. 4 is a line drawing illustrating a rear or back view of the removable pocket 300, according to one embodiment of the concepts and technologies disclosed herein. As shown in FIG. 4, some embodiments of the removable pocket 300 can include a retractable cord or carrying strap (hereinafter "retractable cord") 400. It should be understood that the retractable cord 400 can have any desired length, thickness, and/or configuration and that the illustrated embodiment is merely illustrative of the concepts and technologies disclosed herein.

The retractable cord 400 can be used to carry the removable pocket 300, thereby effectively converting the removable pocket 300 into a purse or pocketbook, in some embodiments. In some other embodiments, the retractable cord 400 can be used by a wearer to further secure the removable pocket 300 (e.g., to protect valuables stored in the removable pocket 300) from loss or theft (e.g., by wrapping or attaching the retractable cord 400 to the wearer's waist, shoulder, or the like; attaching the retractable cord 400 to the belt 106 of the configurable garment 100; or the like). Because the retractable cord 400 can be used for additional and/or alternative reasons, it should be understood that this example is illustrative, and therefore should not be construed as being limiting in any way.

The functionality of the retractable cord 400 can be provided in some embodiments by a rope, cord, or strap that can be made from leather, plastic, woven natural and/or synthetic materials (e.g., cotton, NYLON®, etc.), metals, wood, combinations thereof, or the like. In various embodiments of the concepts and technologies disclosed herein, the retractable cord 400 can be made from a stretchable material such as, for example, a rubber or other elastic core that can be surrounded by a natural and/or synthetic sheath (e.g., similar to a bungee cord, or the like). Because the retractable cord 400 can be made from additional and/or alternative materials, because the retractable cord 400 is optional in some embodiments of the concepts and technologies disclosed herein, and because the retractable cord 400 can be used for additional and/or alternative purposes, it should be understood that the above example embodiments are illustrative, and therefore should not be construed as being limiting in any way.

As can be seen in FIG. 4, the pocket snaps 304 can pass through the removable pocket 300 in some embodiments (e.g., the pocket snaps 304 can be visible on a front of the removable pocket 300 as shown in FIG. 3 and also can be visible on a back of the removable pocket 300 as shown in FIG. 4). In some other embodiments, the pocket snaps 304 may be attached to or pass through one layer of fabric of the removable pocket 300 (e.g., a layer of fabric of the removable pocket 300 that faces the rear or back of the removable pocket 300), and as such, the pocket snaps 304 may not be visible from the front of the removable pocket 300 as noted above. As such, it should be understood that the embodiment illustrated in FIGS. 3-4 is illustrative and should not be construed as being limiting in any way.

The pocket snaps 304 can be used to connect the removable pocket 300 to the configurable garment 100, as explained above. In various embodiments of the configurable garment 100, for example the embodiment illustrated in FIGS. 1-4, the pocket snaps 304 can include male snaps on the rear side of the removable pocket 300. The male snaps that can function as the pocket snaps 304 can engage female snaps that can provide the functionality of the pocket connector snaps 110 of the pocket attachment areas 112. The engagement of the pocket snaps 304 to the pocket connector snaps 110 can secure the removable pocket 300 to the pocket attachment area 112, and thereby can connect the removable pocket 300 to the configurable garment 100. Of course, it should be understood that the functionality of the pocket snaps 304 can be provided by female snaps that can engage male snaps that can provide the functionality of the pocket connector snaps 110 of the pocket attachment areas 112, thereby securing the removable pocket 300 against the pocket attachment area 112 and thereby to the configurable garment 100. As such, it should be understood that the illustrated embodiment is illustrative and should not be construed as being limiting in any way.

It can be appreciated that the retractable cord 400 of the removable pocket 300 can be extended or retracted before attaching the removable pocket 300 to the configurable garment 100 in various embodiments. In some embodiments, for example, the wearer may place the retractable cord 400 over the head and shoulder, around the waist, around the neck, around the belt 106, or the like; thereby protecting the removable pocket 300 and/or its contents from loss and/or theft. Such use of the retractable cord 400 can occur before securing the removable pocket 300 to the configurable garment 100 using the pocket snaps 304, or after. It should be understood that this example use of the retractable cord 400 is illustrative, and therefore should not be construed as being limiting in any way.

Figure 5:
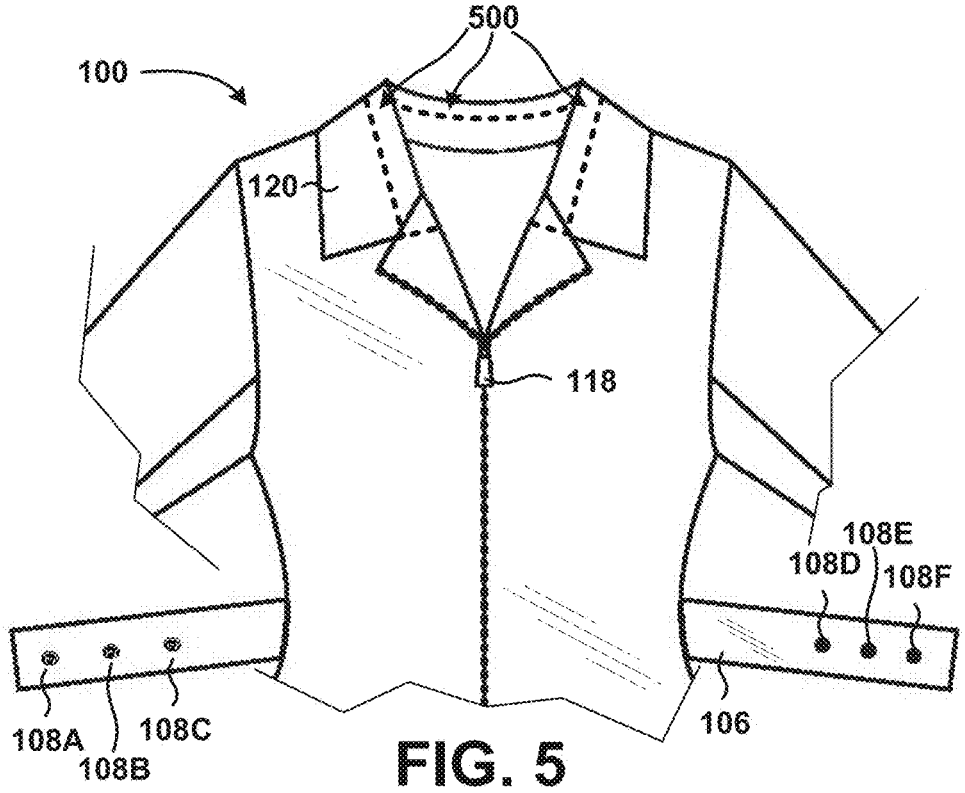
FIGS. 5-6 are line drawings illustrating additional features of a configurable garment, according to some illustrative embodiments of the concepts and technologies disclosed herein.
Figure 6:
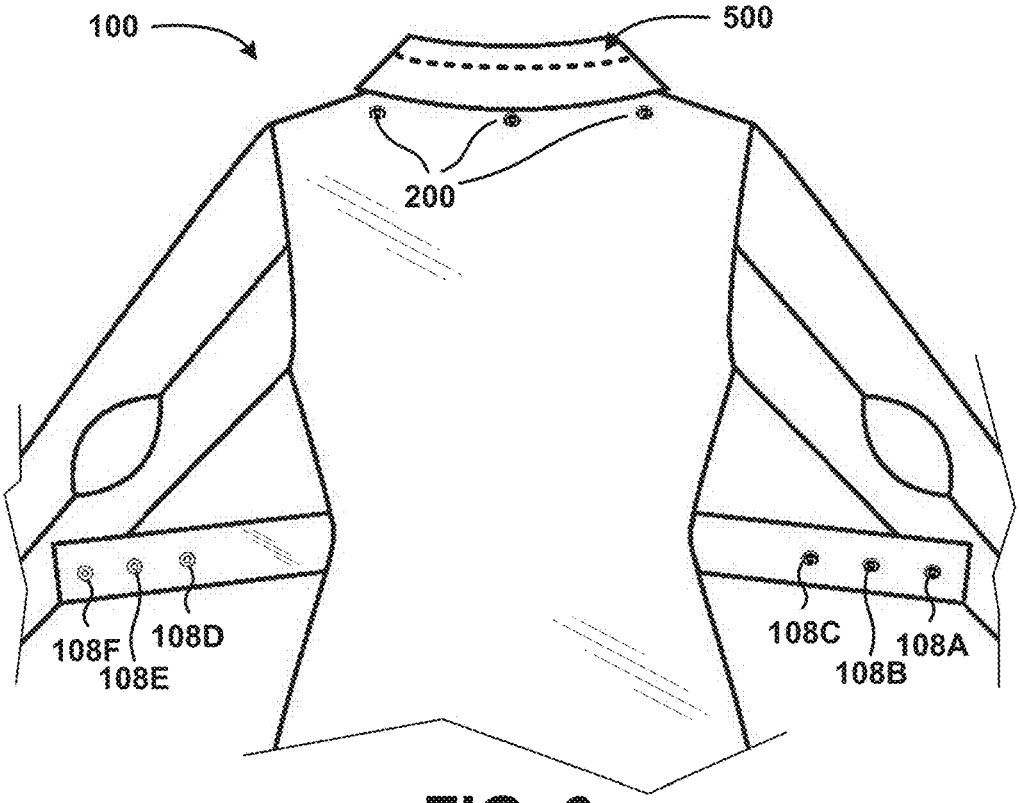

Turning now to FIGS. 5-6, additional details of the configurable garment 100 will be illustrated and described in detail. In particular, FIGS. 5-6 illustrate front and rear or back views, respectively, on the configurable garment 100 illustrated in FIGS. 1-2, according to some example embodiments. As can be seen in FIG. 5, the collar 120 of the configurable garment 100 is illustrated as being partially open as a result of the zipper 118 being partially open. It should be understood that this example is illustrative, and therefore should not be construed as being limiting in any way. Also shown in FIGS. 5-6, the belt 106 is illustrated as being open to reveal the belt attachment mechanisms 108 of the belt 106.

In particular, in the embodiment illustrated in FIG. 5, the functionality of the belt attachment mechanisms 108 is provided by snaps where the belt attachment mechanisms 108A-C are arranged to include male snaps extending from an inner surface of the belt 106; and the belt attachment mechanism 108D-F are arranged to include female snaps extending from the outer surface of the belt 106. Thus, a wearer or other entity can selectively engage the belt attachment mechanisms 108 to secure the belt 106 to itself. Of course, it should be understood that in some embodiments the belt attachment mechanisms 108A-C can be arranged to include female snaps extending from an inner surface of the belt 106; and the belt attachment mechanism 108D-F can be arranged to include male snaps extending from the outer surface of the belt 106. As such, it should be understood that the illustrated example is illustrative, and therefore should not be construed as being limiting in any way.

Also shown in FIG. 5 is an embodiment wherein the collar 120 includes a drawstring passageway 500, which can be formed in the interior of the collar 120 (e.g., between two layers of material that can provide the collar 120). The drawstring passageway 500 can be formed in the collar 120 and/or in the removable hood illustrated and described hereinbelow. The drawstring passageway 500 can be configured to provide a passageway for a drawstring to encircle the neck or head of the wearer and to be tied to tighten the collar 120 when desired. In some embodiments, the drawstring passageway 500 can be omitted from the collar 120. In yet other embodiments, the drawstring passageway 500 can be omitted from the configurable garment 100, and hoops, loops, or the like can be provided on an underside of the collar 120 or on the bodice 104 of the configurable garment 100 to accommodate a drawstring. As such, it should be understood that the illustrated embodiment is illustrative and should not be construed as being limiting in any way.

FIG. 6 illustrates a rear view of the configurable garment 100 shown in FIG. 5, according to one illustrative embodiment of the concepts and technologies disclosed herein. In FIG. 6, the drawstring passageway 500 is visible. As noted above, the drawstring passageway 500 can be omitted from the collar 120 and/or substituted with other structures such as, for example, hoops or the like on an underside of the collar 120 or on the bodice 104 of the configurable garment 100 to accommodate a drawstring. As such, it should be understood that the illustrated embodiment is illustrative and should not be construed as being limiting in any way.

Also shown in FIG. 6 are one or more snaps, buttons, magnets, VELCRO, zippers, and/or other mechanical fasteners are shown as providing the hood connector snaps 200. The hood connector snaps 200 can be configured to engage one or more snaps, buttons, magnets, VELCRO, zippers, and/or other mechanical fasteners ("hood snaps")(not visible in FIG. 6) that can be formed on a removable hood, as will be illustrated and described in detail with reference to FIG. 7. In the illustrated embodiment shown in FIG. 6, the hood connector snaps 200 are illustrated as including male snaps that can engage female snaps of the removable hood. It should be understood that the functionality of the hood connector snaps 200 can include female snaps that can engage male snaps of the removable hood. As such, it should be understood that the illustrated embodiment is illustrative and should not be construed as being limiting in any way.

Figure 7:
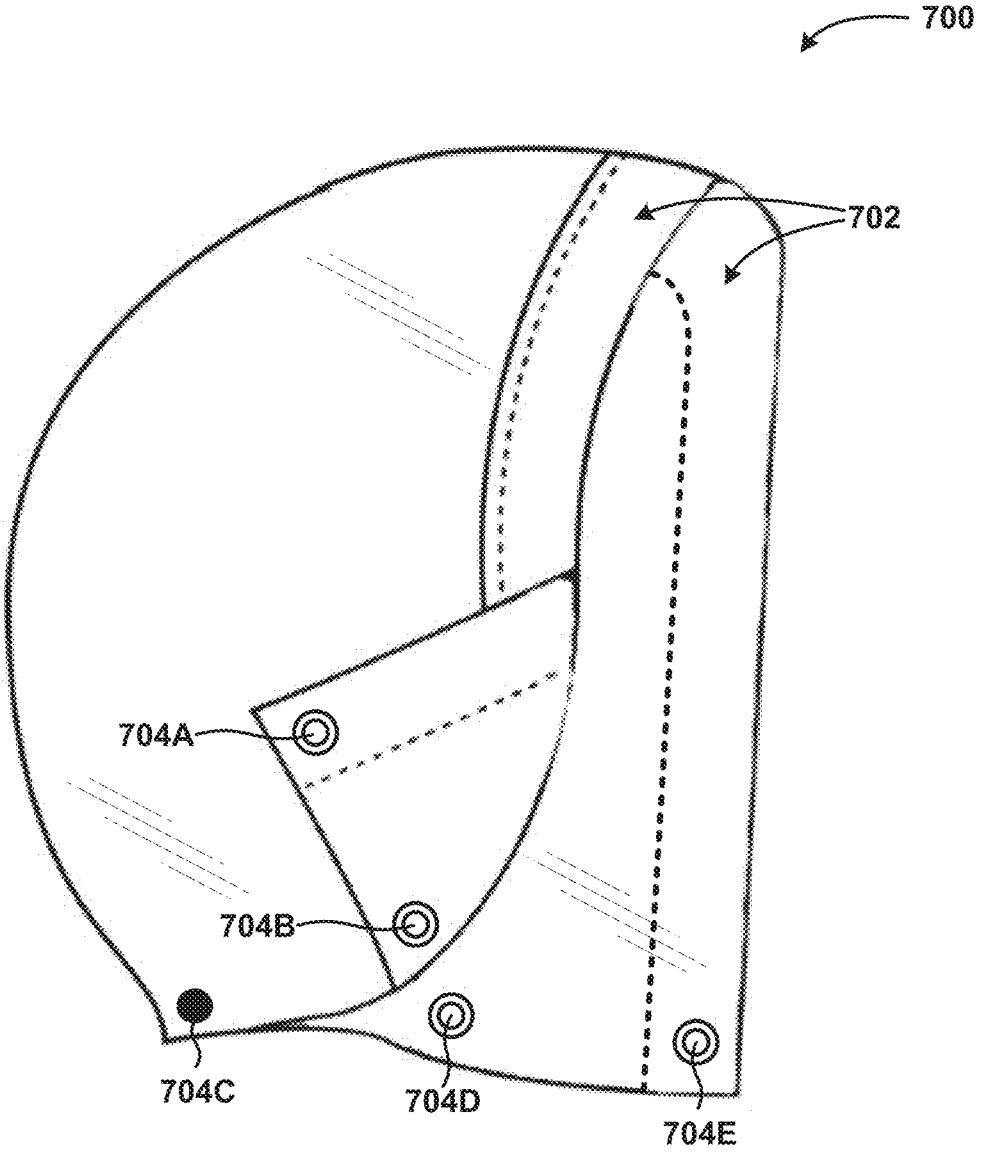
FIG. 7 is a line drawing illustrating a removable hood for a configurable garment, according to one illustrative embodiment of the concepts and technologies disclosed herein.

Turning now to FIG. 7, an example of a removable hood 700 that can be attached to, connected to, detached from, and/or disconnected from the configurable garment 100 will be illustrated in detail, according to an example embodiment of the concepts and technologies disclosed herein. It should be understood that the removable hood 700 shown in FIG. 7 is illustrative of one embodiment of the removable hood 700 and therefore should not be construed as being limiting in any way.

As shown in FIG. 7, the removable hood 700 can include a drawstring passageway 702. The drawstring passageway 702 of the removable hood 700 can be similar or even identical to the drawstring passageway 500 illustrated and described above with reference to FIG. 500, in some embodiments. The drawstring passageway 702 can be formed in the interior of the removable hood 700 (e.g., between two layers of material that can provide the removable hood 700) in some embodiments. The drawstring passageway 702 can be configured to provide a passageway for a drawstring to encircle the head or neck of the wearer (e.g., the head when the removable hood 700 is worn on the head and/or around the neck when the removable hood 700 is taken off the head). The drawstring that passes through the drawstring passageway 702 can be tied to tighten the removable hood 700 when and/or if desired. In some embodiments, the drawstring passageway 702 can be omitted from the removable hood 700 or replaced with hoops or other structures that can be provided on or in the removable hood 700 to accommodate a drawstring. As such, it should be understood that the illustrated embodiment is illustrative and should not be construed as being limiting in any way.

The removable hood 700 also can include one or more snaps, buttons, magnets, VELCRO, zippers, and/or other mechanical fasteners ("hood snaps") 704A-E (hereinafter collectively and/or generically referred to as "hood snaps 704"). As shown in FIG. 7, the hood snaps 704 can include male snaps on an interior of the removable hood 700. The male snaps that function as the hood snaps 704 can engage female snaps that can provide the functionality of the hood connector snaps 200 of the configurable garment 100, thereby securing the removable hood 700 to the configurable garment 100. Of course, it should be understood that the functionality of the hood snaps 704 can be provided by female snaps that can engage male snaps that can provide the functionality of the hood connector snaps 200, thereby securing the removable hood 700 to the configurable garment 100. As such, it should be understood that the illustrated embodiment is illustrative and should not be construed as being limiting in any way.

Figure 8:
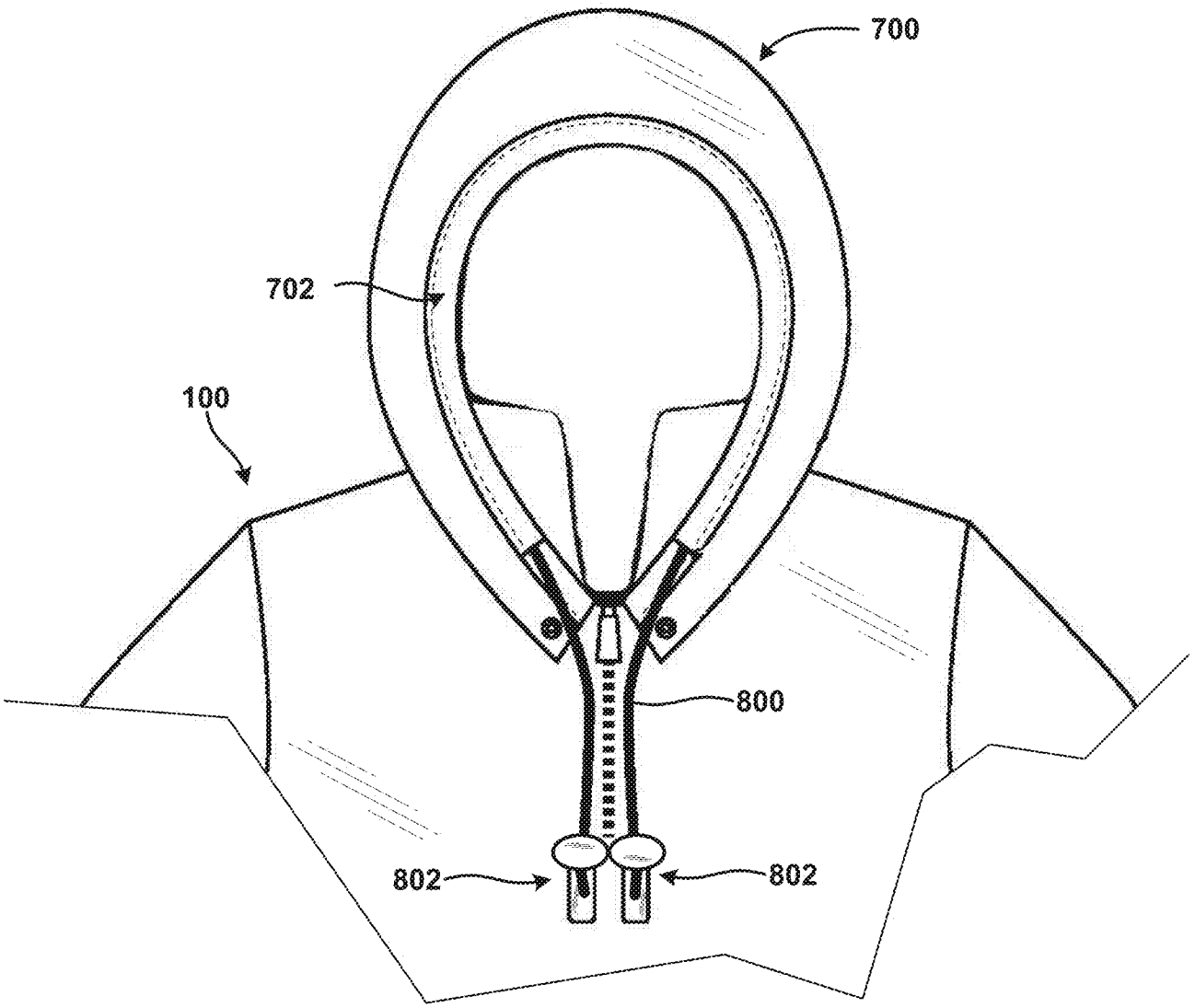
FIG. 8 is a line drawing illustrating an earpod holder for a configurable garment, according to one illustrative embodiment of the concepts and technologies disclosed herein.

Turning now to FIG. 8, additional aspects of the configurable garment 100 will be illustrated and described in detail. In particular, FIG. 8 illustrates an example of the removable hood 700 as being connected to the configurable garment 100. Thus, in the configuration illustrated in FIG. 8, the configurable garment 100 includes a hood, which can be provided by the removable hood 700. Additionally, the removable hood 700 is illustrated as including the drawstring passageway 702 as illustrated and described hereinabove with reference to FIG. 7. It should be understood that the illustrated embodiment is illustrative, and therefore should not be construed as being limiting in any way.

As shown in FIG. 8, a drawstring 800 can be located in the drawstring passageway 702 of the removable hood 700. According to some embodiments of the concepts and technologies disclosed herein, the drawstring 800 can be formed from a stretchable material such as an elastic material (e.g., knitted, braided, woven, or otherwise manufactured rubber) that can be formed into a central cord with a natural (e.g., cotton, etc.) or synthetic (e.g., nylon, etc.) sheath. In some other embodiments, the drawstring 800 may be formed from a non-stretchable material that includes natural and/or man-made fabrics, wood, metal, plastic, combinations thereof, or the like. Because additional and/or alternative materials can be used to form the drawstring 800, it should be understood that the above examples are illustrative, and therefore should not be construed as being limiting in any way.

Although FIG. 8 illustrates the drawstring 800 as passing through the drawstring passageway 702, it can be appreciated that the drawstring 800 can alternatively be located in the drawstring passageway 500 of the configurable garment 100 in some embodiments. As such, the illustrated embodiment should be understood as being illustrative and should not be construed as being limiting in any way.

As shown in FIG. 8, one or more earpod holders 802 can be attached or connected to the drawstring 800. In some embodiments, the earpod holders 802 can be formed as a part of the drawstrings 800, while in some other embodiments, the earpod holders 802 can be removable, as in the embodiment illustrated herein. The earpod holders 802 can be configured to be connected or attached to the drawstring 800 and to hold one or more wired and/or wireless earpods (not illustrated in FIG. 8) such as, for example, one or more wired earpods; one or more members of the wireless AIRPOD® brand earpods from APPLE Inc. in Cupertino, California; one or more other types of earpods; one or more other devices; combinations thereof; or the like. It can therefore be appreciated that the earpod holders 802 can be connected to a drawstring 800 or other string or cord in accordance with various embodiments of the concepts and technologies disclosed herein. As such, it should be understood that the illustrated embodiment is illustrative, and therefore should not be construed as being limiting in any way.

Figure 9:
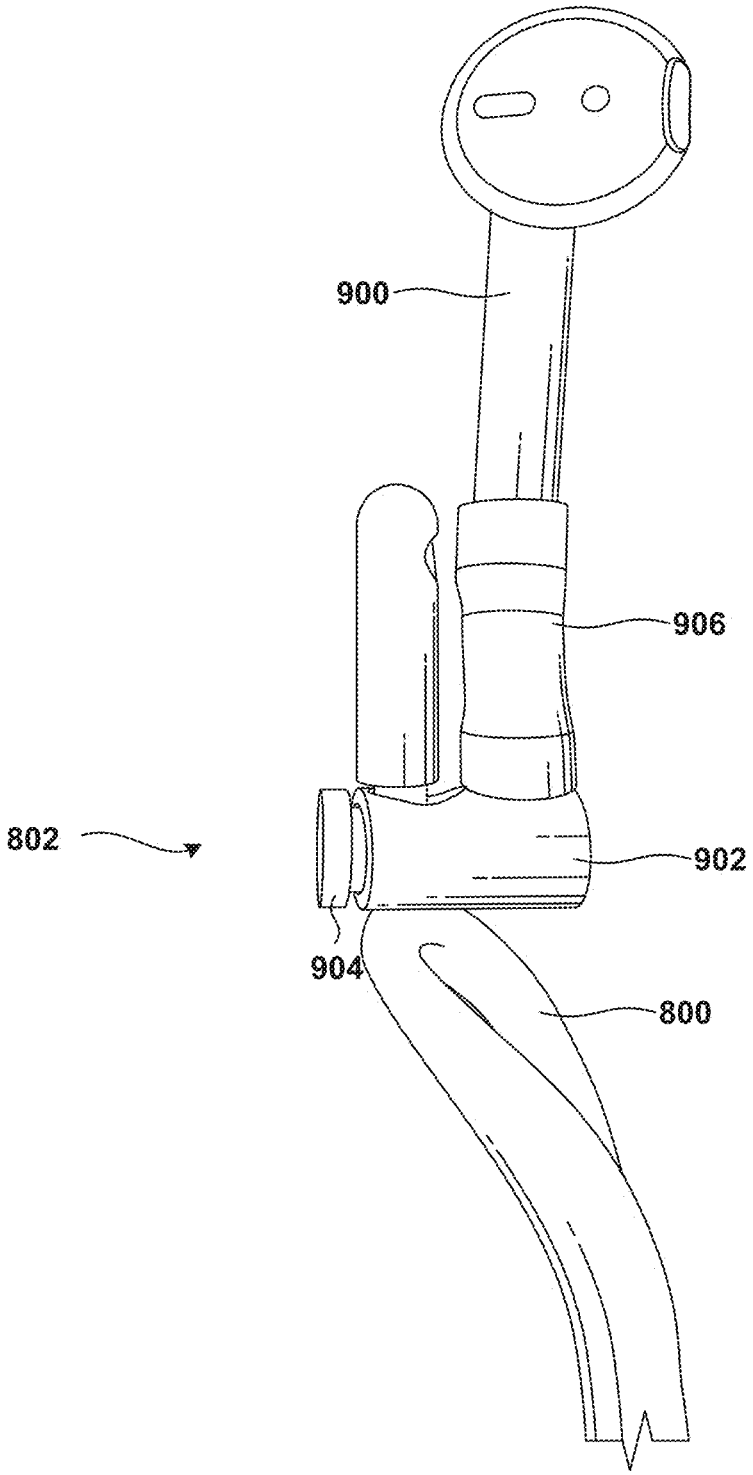
FIG. 9 is a line drawing that illustrates a perspective view of an earpod holder, according to one illustrative embodiment of the concepts and technologies disclosed herein.

Turning now to FIG. 9, additional aspects of one contemplated embodiment of the earpod holders 802 will be illustrated and described in detail. The embodiment of the earpod holder 802 illustrated in FIGS. 9-22 can be selectively attached and/or detached from a drawstring 800 or other structure as illustrated and described herein. It should be understood that this example is illustrative, and therefore should not be construed as being limiting in any way.

In FIG. 9, a wireless earpod 900 is illustrated as being held by an earpod holder 802. In the illustrated embodiment, the wireless earpod 900 is illustrated as being a member of the AIRPOD® family of earpod products from Apple Inc. in Cupertino, California. It should be understood that this example embodiment is illustrative and should not be construed as being limiting in any way. Other types of listening devices (e.g., hearing aids, wired earpods, etc.) can be substituted for the wireless earpod 900 according to various embodiments of the concepts and technologies disclosed herein. As such, it should be understood that this example is illustrative, and therefore should not be construed as being limiting in any way.

As shown in FIG. 9, some embodiments of the earpod holder 802 can include several components, each of which will be illustrated and described in more detail hereinbelow with reference to FIGS. 10-22. Briefly, the earpod holder 802 can include an earpod holder body portion (hereinafter "body portion") 902, an earpod holder button portion (hereinafter "button portion") 904, and a tube or sleeve (hereinafter "sleeve") 906 that can be connected to the body portion 902. According to various embodiments of the concepts and technologies disclosed herein, the sleeve 906 can include a tube of material (e.g., a rubber tube, a santoprene tube, a stretchable and/or compressible fabric tube, or the like). It should be understood that this example is illustrative, and therefore should not be construed as being limiting in any way.

According to various embodiments of the concepts and technologies disclosed herein, the sleeve 906 can include a continuous-flex tube having a hardness rating of "soft" and a Durometer hardness of 65A, where the tube can be made from santoprene with an inside diameter of about three sixteenths of an inch and an outside diameter of about five sixteenths of an inch. One commercial embodiment of a suitable material that can function as the sleeve 906 is a portion of a continuous flex santoprene tube for chemicals, which is available from McMaster-Carr® as part number 51225K24. Because other materials and/or other commercial embodiments can be used to provide the functionality of the sleeve 906 illustrated and described herein, it should be understood that this example is illustrative, and therefore should not be construed as being limiting in any way.

The sleeve 906 can engage and/or hold the wireless earpod 900, as shown in FIG. 9. Additionally, it can be appreciated with reference to FIG. 9 that the drawstring 800 can be engaged by the earpod holder 802. In particular, as will be made clearer with reference to FIG. 10-22 below, the drawstring 800 can pass through the body portion 902 and the button portion 904 of the earpod holder 802, and can be engaged by the body portion 902 and the button portion 904. It should be understood that this example is illustrative, and therefore should not be construed as being limiting in any way.

Figure 10:
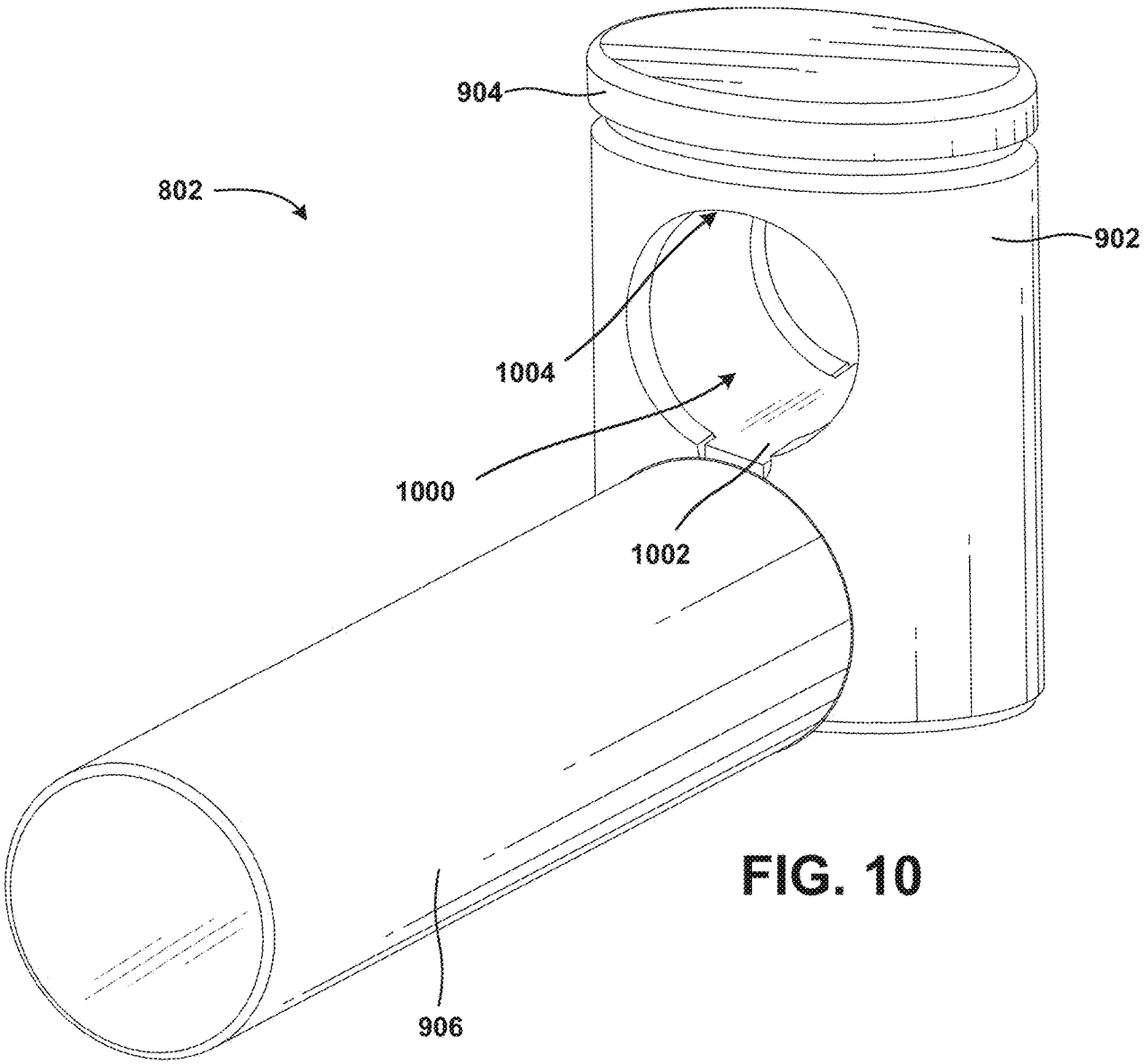
FIG. 10 is a line drawing that illustrates a perspective view of the earpod holder, according to one illustrative embodiment of the concepts and technologies disclosed herein.

Turning now to FIG. 10, additional aspects of the earpod holder 802 will be illustrated and described in additional detail. As can be seen in FIG. 10, a passageway 1000 can be cooperatively formed by the body portion 902 and the button portion 904. As will be more clearly understood with reference to FIG. 11, the button portion 904 can be spring loaded so that a force can be exerted onto the button portion 904 to push a drawstring engagement surface 1002 of the button portion 904 toward a top 1004 of the passageway 1000. Thus, the force generated by the spring can be imparted, by the button portion 904 and via the drawstring engagement surface 1002, on the drawstring 800 to secure the earpod holder 802 to the drawstring 800. Thus, the earpod holder 802 can be used to prevent the wireless earpod 900 (or other device held by the earpod holder 802) from being lost or dropped by a wearer or carrier. It should be understood that this example is illustrative, and therefore should not be construed as being limiting in any way.

Figure 11:
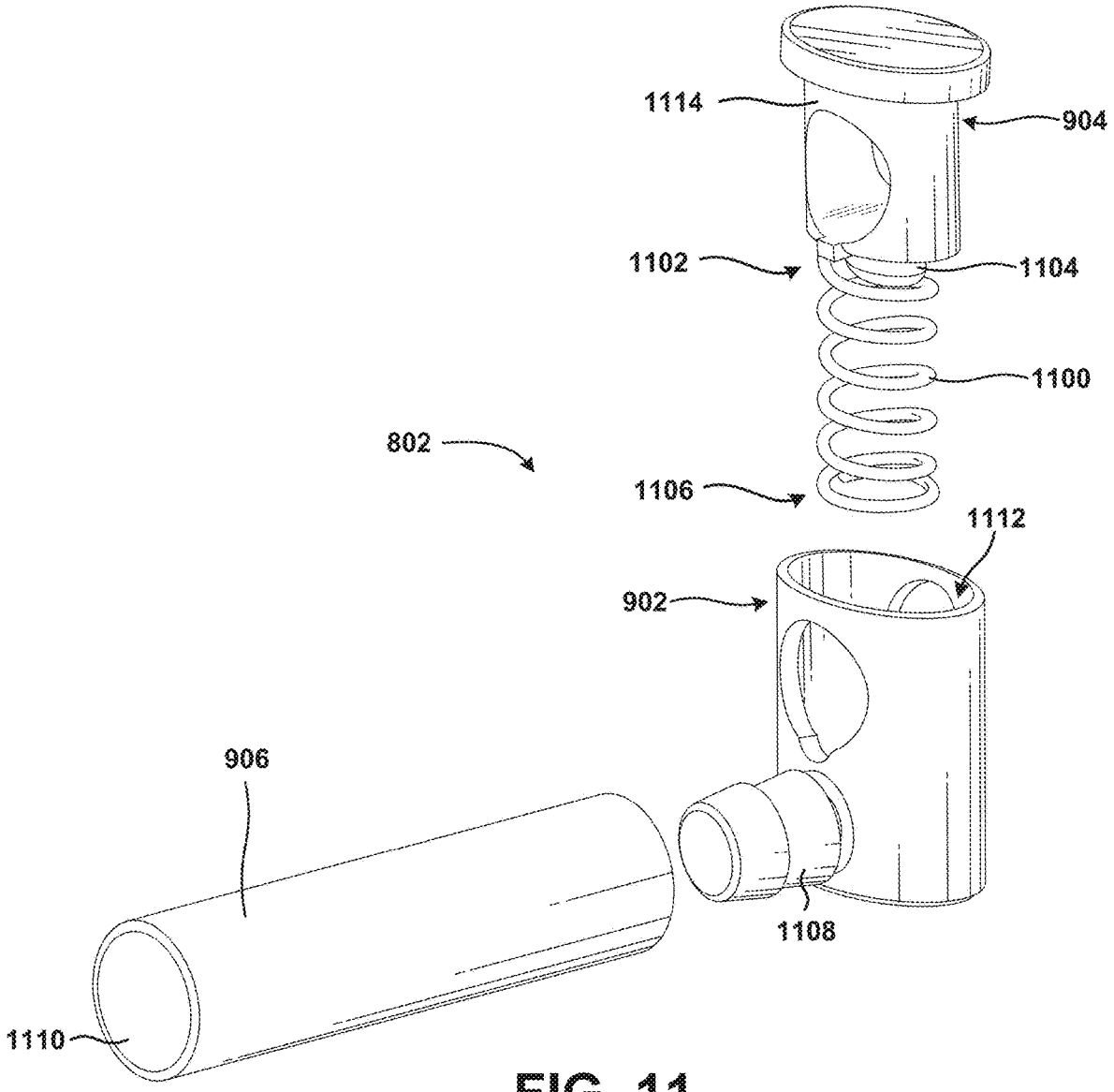
FIG. 11 is a line drawing that illustrates an exploded perspective view of an assembly of the earpod holder from its components, according to one illustrative embodiment of the concepts and technologies disclosed herein.

Turning now to FIG. 11, additional aspects of the earpod holder 802 will be illustrated and described in additional detail. As can be seen in FIG. 11, a spring 1100 can be located between the body portion 902 and the button portion 904. According to various embodiments of the concepts and technologies disclosed herein, the spring 1100 can include a compression spring having a rate of about twenty three and a half pounds per inch of compressive force, though higher or lower levels of compressive force are possible and are contemplated. One commercial embodiment of a suitable compression spring that can function as the spring 1100 is a one half inch long compression spring having an outside diameter of about 0.24 inches and an inside diameter of about 0.182 inches, which is available from McMaster-Carr® as part number 9657K271. It should be understood that this example is illustrative, and therefore should not be construed as being limiting in any way.

According to various embodiments of the concepts and technologies disclosed herein, a first end 1102 of the spring 1100 can be attached to the button portion 904. In the illustrated embodiment, the first end 1102 of the spring 1100 can be sized and/or dimensioned to engage (e.g., via a compression attachment and/or via one or more chemical or mechanical fasteners) a spring retention structure (hereinafter "button spring retainer") 1104. It can be appreciated that the button spring retainer 1104 can also be configured to prevent the spring 1100 from bending, buckling, and/or moving out of position by filling the inner space or void of the first end 1102 of the spring 1100 with the outer surfaces of the button spring retainer 1104. Although not visible in FIG. 11, it should be understood that a similar spring retention structure can be located within the body portion 902 to engage the second end 1106 of the spring 1100. It should be understood that this example is illustrative, and therefore should not be construed as being limiting in any way.

The body portion 902 of the earpod holder 802 can include a sleeve retention structure ("sleeve retainer") 1108. The sleeve retainer 1108 can be shaped, sized, and/or dimensioned to engage an inner surface 1110 of the sleeve 906. Thus, it can be appreciated that an outer diameter of the sleeve retainer 1108 can be larger than the inner diameter of the inner surface 1110 of the sleeve 906. According to various embodiments, the sleeve 906 can be dimensioned such that a wireless earpod 900 and the sleeve retainer 1108 can be engaged by the sleeve 906. Thus, it can be appreciated that the diameter of the sleeve retainer 1108 and one structure of the wireless earpod 900 can be similar or even identical, though this is not necessarily the case (e.g., the sleeve 906 need not have a consistent diameter along its entire length). It should be understood that this example is illustrative, and therefore should not be construed as being limiting in any way.

In various embodiments of the concepts and technologies disclosed herein, the sleeve 906 can be pushed onto the sleeve retainer 1108, and a compressive force generated by the sleeve 906 can hold the sleeve 906 in place relative to the sleeve retainer 1108. It should be understood that this example is illustrative, and therefore should not be construed as being limiting in any way.

As shown in FIG. 11, the body portion can include a cavity or void (hereinafter referred to as a "body portion void") 1112. An inner surface of the body portion void 1112 can be configured to engage and/or interface with a button guide surface 1114 of the button portion 904. Thus, it can be appreciated that the body portion void 1112 can have a shape that is similar (or even identical) to the button guide surface 1114 in various embodiments, while in some other embodiments these components may have configurations that can complement one another instead. Thus, it can be appreciated that a cross-section of the body portion 902 (e.g., the shape of a transverse portion of the sidewalls 1200) can have a similar or even identical shape, configuration, and/or dimensions, in some embodiments, although this is not necessarily the case. As such, it should be understood that the illustrated example is illustrative, and therefore should not be construed as being limiting in any way.

Figure 12:
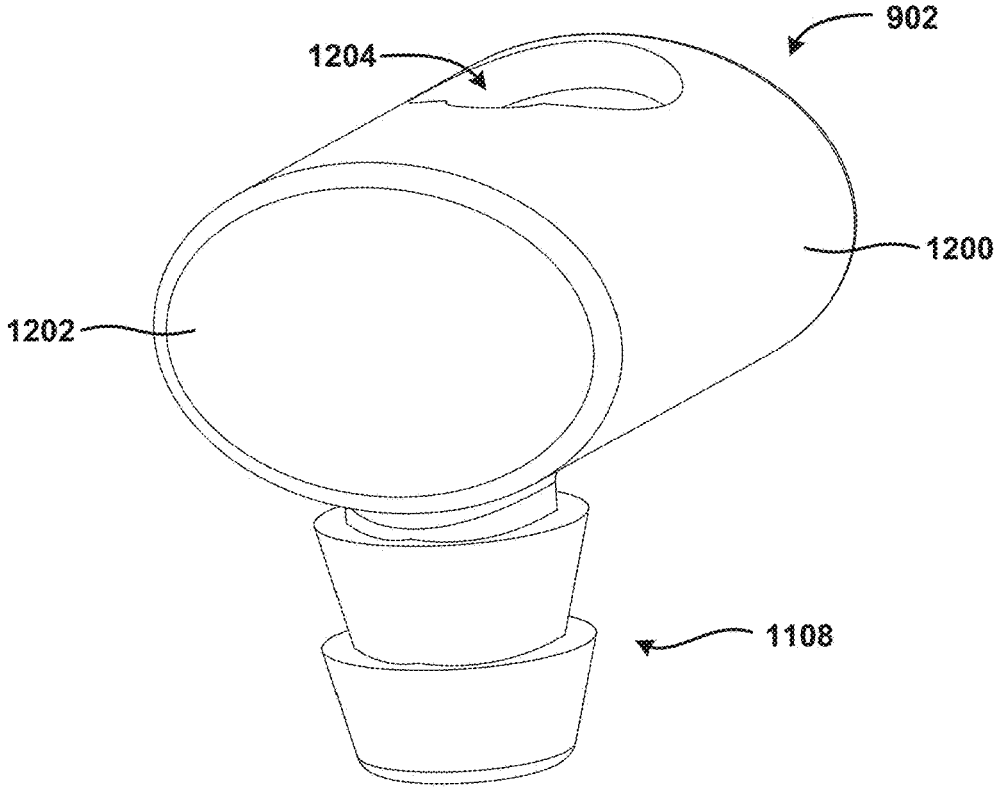
FIGS. 12-15 are line drawings showing perspective views of a body of an earpod holder, according to one illustrative embodiment of the concepts and technologies disclosed herein.
Figure 13:
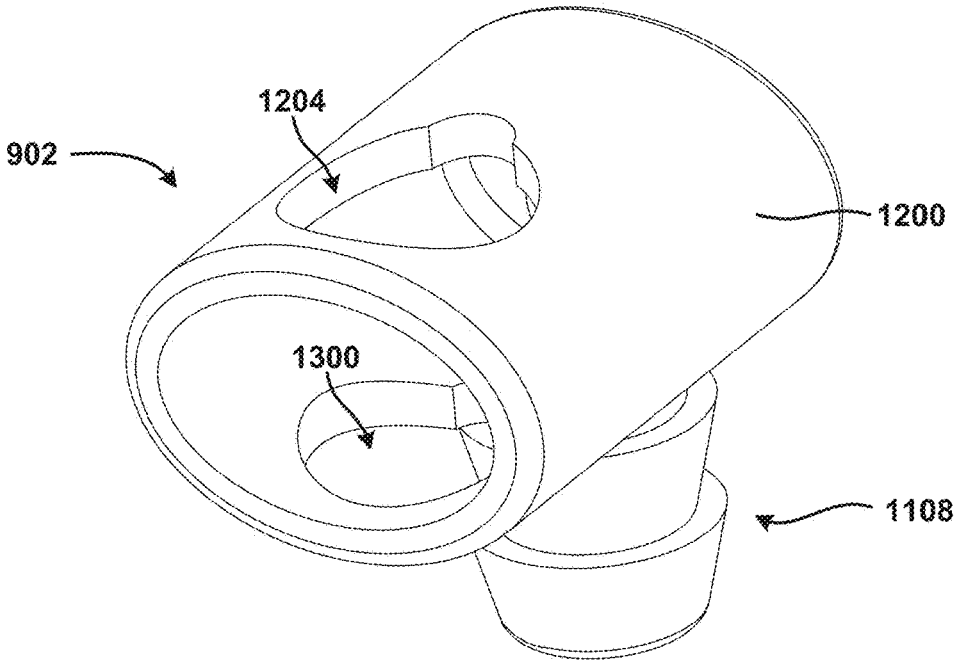

Turning now to FIGS. 12-13, additional aspects of the earpod holder 802 will be illustrated and described in additional detail. In particular, FIGS. 12-13 are line drawings that illustrate the body portion 902 of the earpod holder 802. As can be seen in FIG. 12, the body portion 902 includes the sidewalls 1200, and a body portion support surface 1202. Also visible in FIG. 12 is a front body portion aperture 1204. The front body portion aperture 1204 can correspond to a first aperture through which the drawstring 800 can be passed when attaching the earpod holder 802 to the configurable garment 100, after which the drawstring 800 may be passed through one or more apertures formed in the button portion 904 before being passed through a rear body portion aperture 1300, which is visible in FIG. 13. It should be understood that this example is illustrative, and therefore should not be construed as being limiting in any way.

Figure 14:
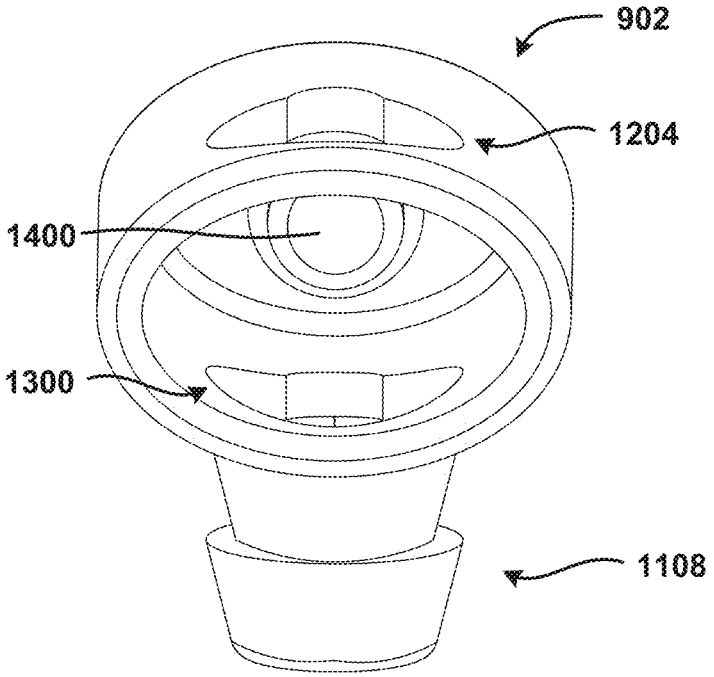
Figure 15:
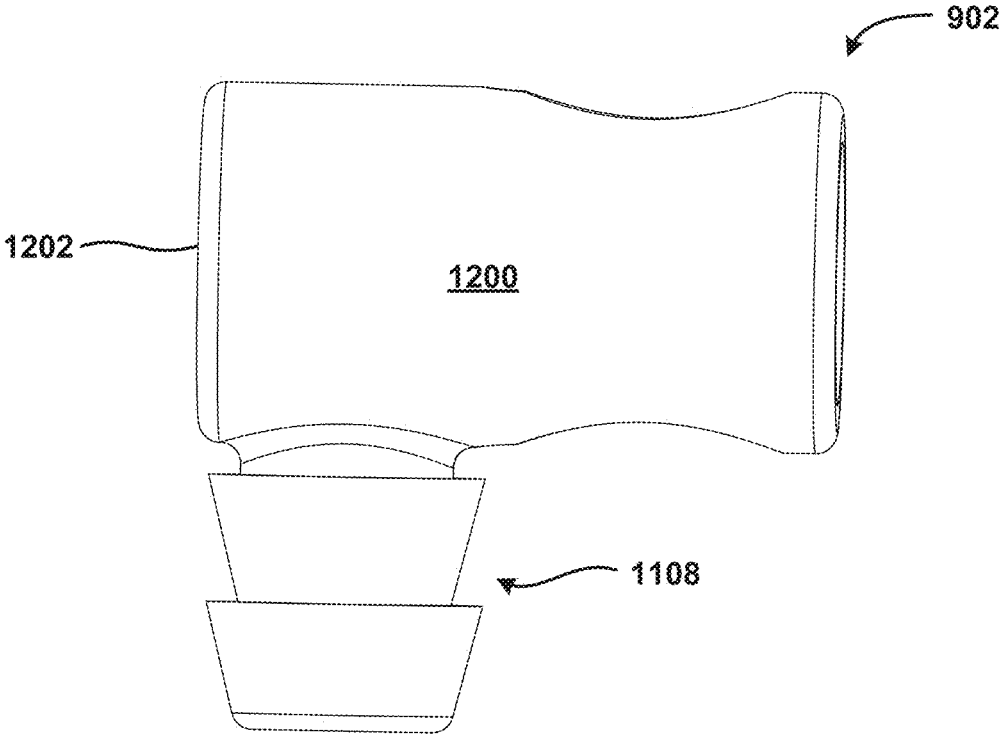

Turning now to FIGS. 14-15, additional aspects of the earpod holder 802 will be illustrated and described in additional detail. In particular, FIGS. 14-15 are line drawings that illustrate additional views of the body portion 902 of the earpod holder 802. In FIG. 14, the front body portion aperture 1204 and the rear body portion aperture 1300 are visible. Additionally visible in FIG. 14 is another spring retention structure (hereinafter "body spring retainer") 1400. The body spring retainer 1400 can be sized and/or dimensioned to engage the spring 1100 illustrated and described herein. It can be appreciated that the body spring retainer 1400 can be substantially similar (or even identical) to the button spring retainer 1104, though this is not necessarily the case. It should be understood that this example is illustrative, and therefore should not be construed as being limiting in any way. FIG. 15 illustrates a side view of the body portion 902 for additional reference.

Figure 17:
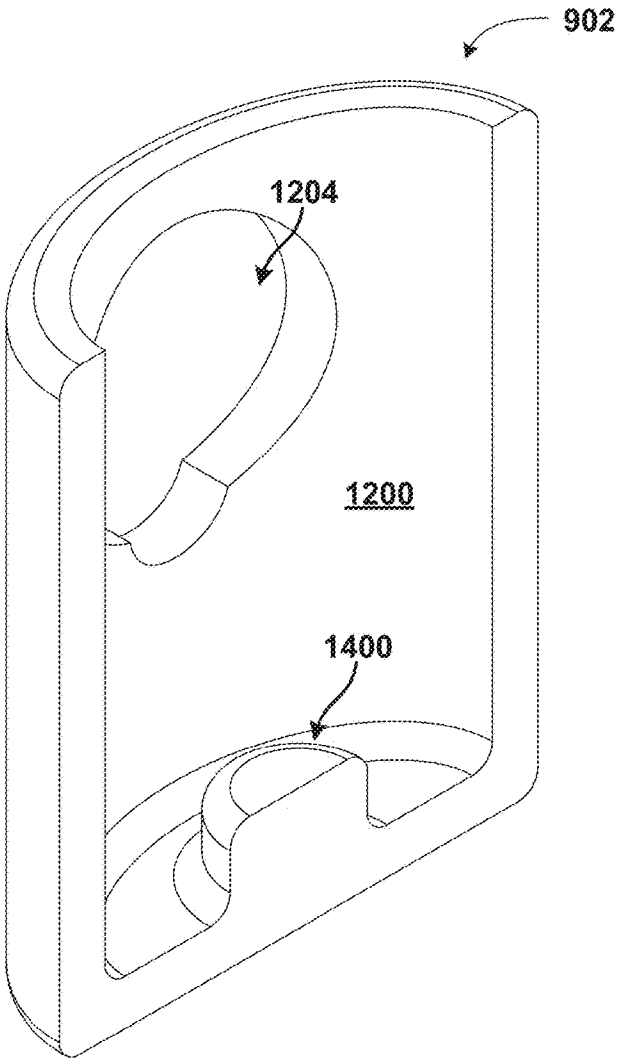
FIGS. 16-17 are line drawings showing cutaway perspective views of a body of an earpod holder, according to one illustrative embodiment of the concepts and technologies disclosed herein.
Figure 16:
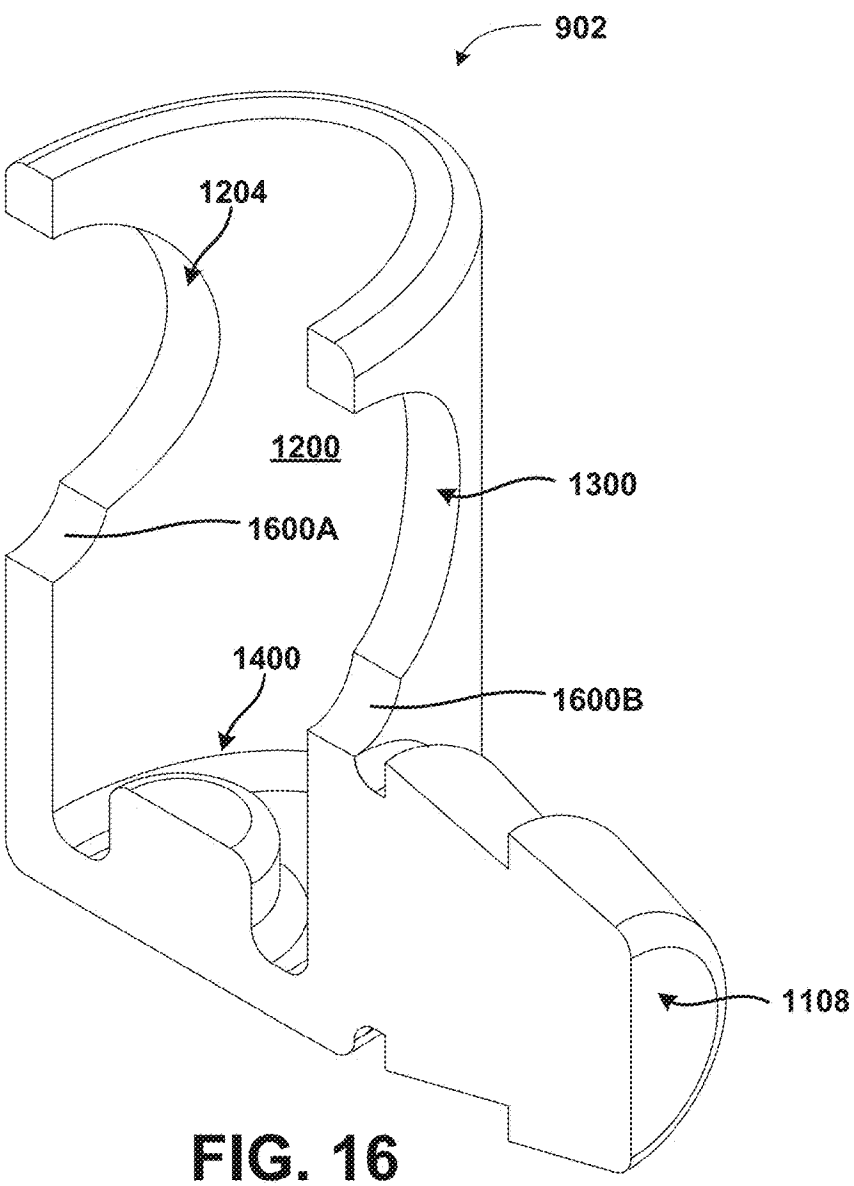

Turning now to FIGS. 16-17, additional aspects of the earpod holder 802 will be illustrated and described in additional detail. In particular, FIG. 16-17 are line drawings that illustrate cutaway perspective views of the body portion 902 of the earpod holder 802. In FIG. 16, approximately one half of the front body portion aperture 1204 and approximately one half of the rear body portion aperture 1300 are visible. In FIG. 17, the entire front body portion aperture 1204 is visible. Additionally visible in FIGS. 16 and 17 is the body spring retainer 1400. In FIG. 16, the sleeve retainer 1108 is visible. Also shown in FIGS. 16-17 are two aperture button retention cutouts 1600A-B (hereinafter collectively and/or generically referred to as "button retention cutouts 1600"), one on each of the front body portion aperture 1204 and the rear body portion aperture 1300. It should be understood that this example is illustrative, and therefore should not be construed as being limiting in any way. The purpose of the button retention cutouts 1600 will be more clearly understood with reference to FIG. 18 below and FIG. 10 above. It should be understood that the illustrated embodiment is illustrative, and therefore should not be construed as being limiting in any way.

Figure 18:
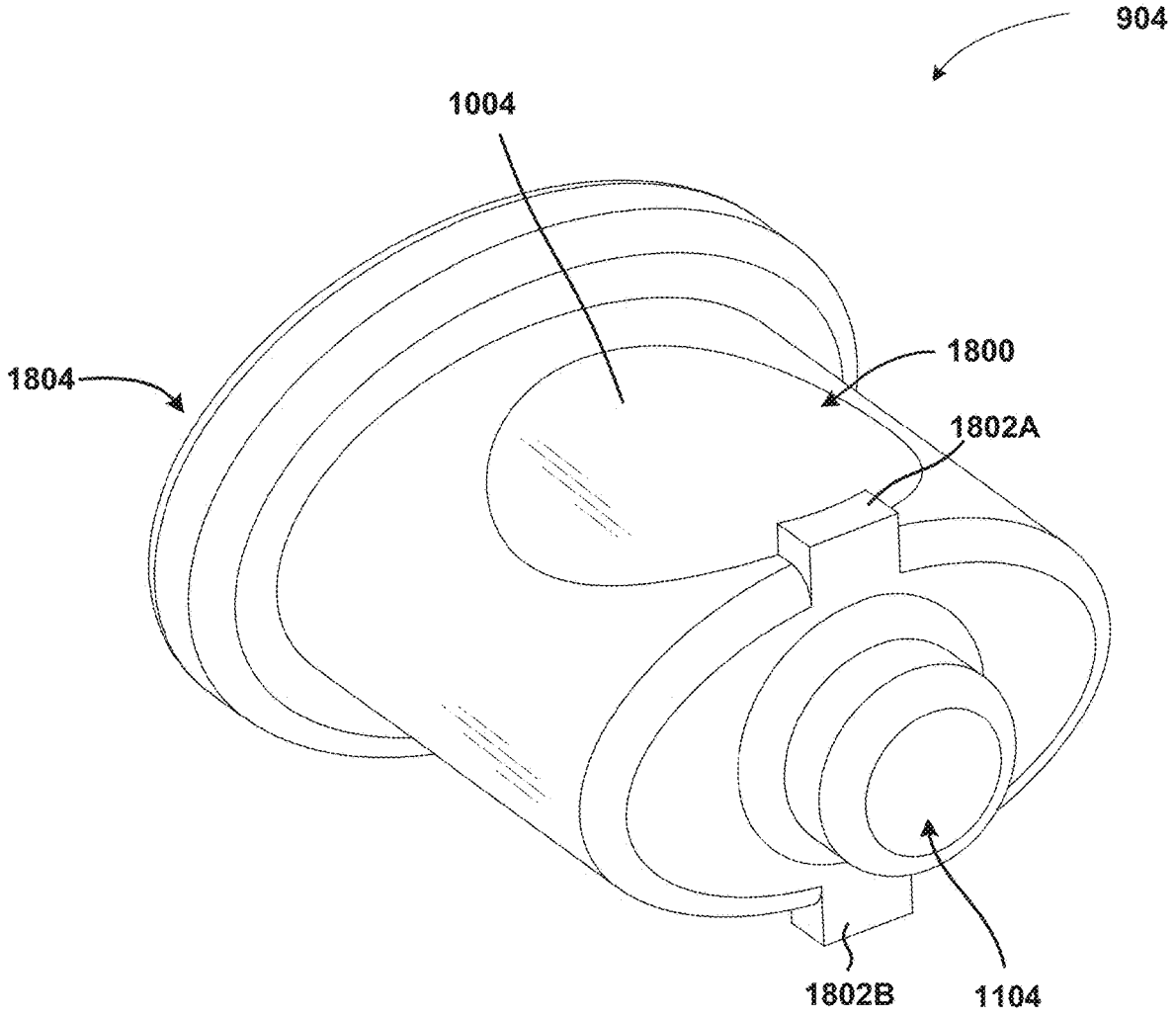
FIGS. 18-20 are line drawings showing perspective views of a button portion of an earpod holder, according to one illustrative embodiment of the concepts and technologies disclosed herein.

Turning now to FIG. 18, additional aspects of the earpod holder 802 will be illustrated and described in additional detail. In particular, FIG. 18 is a line drawing that illustrates a perspective view of the button portion 904 of the earpod holder 802. In FIG. 18, the top 1004 is visible, as is the button aperture 1800, which can cooperate with the front body portion aperture 1204 and rear body portion aperture 1300 to provide the passageway 1000 shown in FIG. 10. Additionally visible in FIG. 18 is the button spring retainer 1104.

Figure 19:
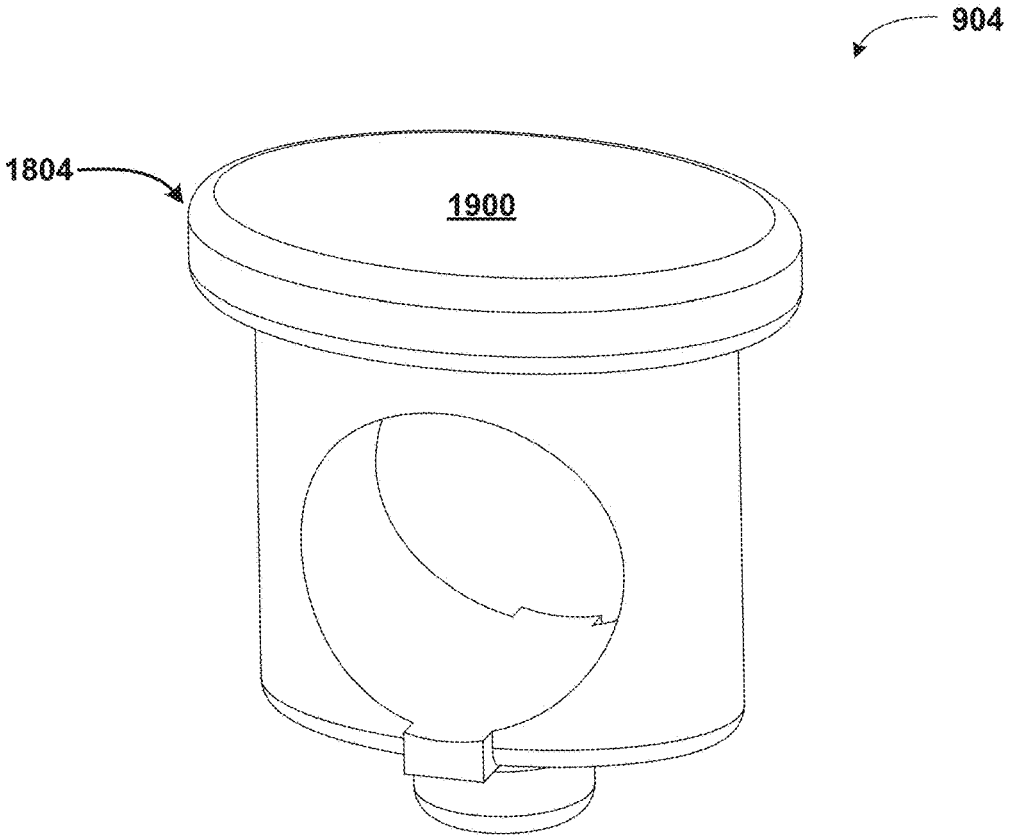
Figure 20:
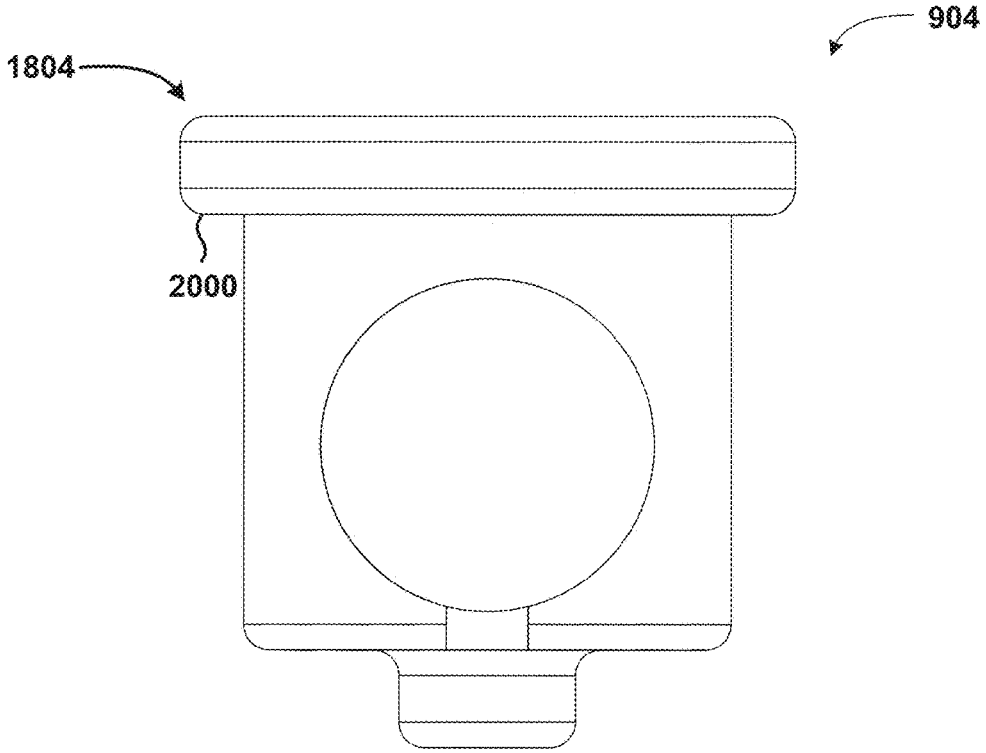

Also visible in FIG. 18 are two button retention slots 1802A-B (hereinafter collectively and/or generically referred to as "button retention slots 1802"). With collective reference to FIGS. 10 and 16-18, it can be appreciated that the button retention slots 1802 of the button portion 904 can be configured to nest into the button retention cutouts 1600, thereby allowing the button aperture 1800 of the button portion 904 to line up with the front body portion aperture 1204 and rear body portion aperture 1300 to create the passageway. It should be understood that the illustrated embodiment is illustrative, and therefore should not be construed as being limiting in any way. FIGS. 19-20 provide additional views of the button portion 904 for purposes of enabling clarification of the various features of the button portion 904. It should be understood that this example is illustrative, and therefore should not be construed as being limiting in any way.

Also visible in FIGS. 18-20 is a lip 1804. The lip 1804 can be configured to prevent the button portion 904 from being pressed into the body portion 902. In particular, the lip 1804 can include a button surface 1900, to which a force can be applied to push the button aperture 1800 into alignment with the rear body portion aperture 1300 and the front body portion aperture 1204 to allow insertion of the drawstring 800 or other structure. The lip 1804 also can include a sidewall engagement surface 2000, which can be configured to engage the sidewalls 1200 of the body portion 902, thereby preventing the button portion 904 from being pushed into the body portion 902 as noted above. It can be appreciated that the button retention cutouts 1600 and the button retention slots 1802 can cooperate to provide a similar benefit, so the sidewall engagement surface 2000 and the sidewalls 1200 may interact to reduce stress on and/or to compliment the function of the interacting button retention cutouts 1600 and the button retention slots 1802. It should be understood that this example is illustrative, and therefore should not be construed as being limiting in any way.

Figure 22:
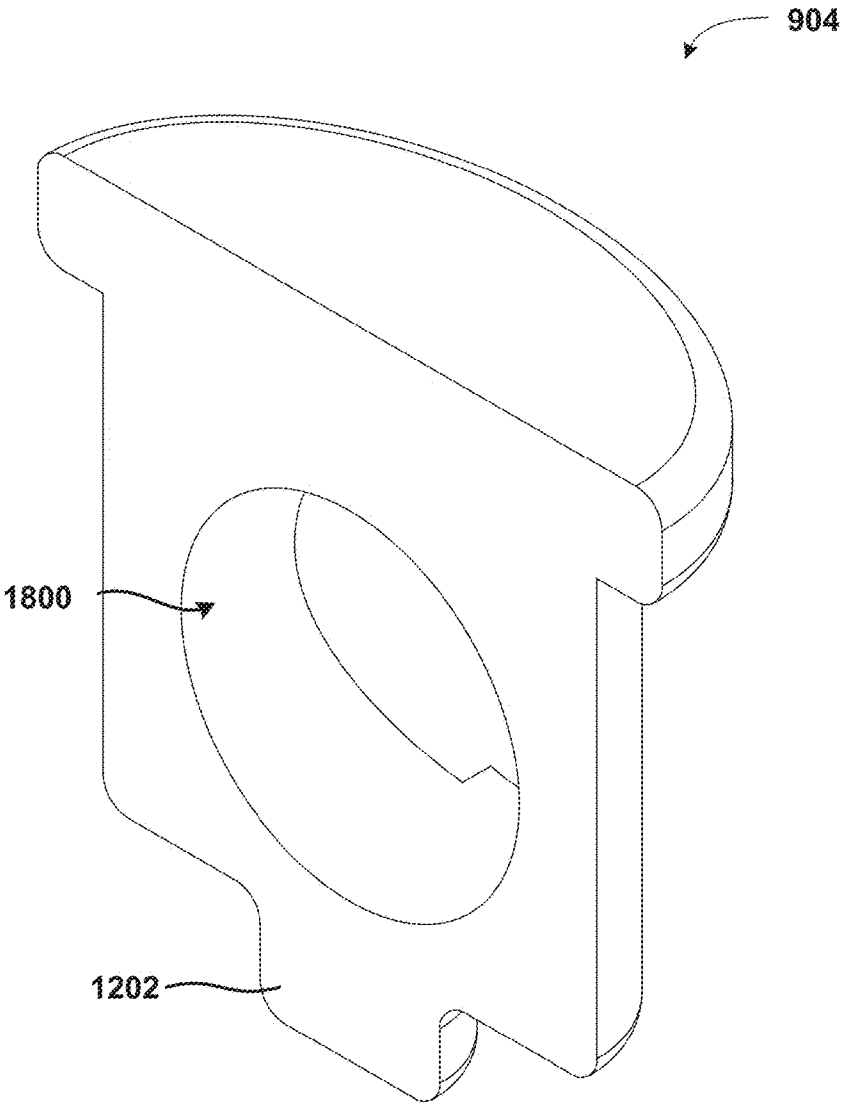
FIGS. 21-22 are line drawing showing cutaway perspective views of a button portion of an earpod holder, according to one illustrative embodiment of the concepts and technologies disclosed herein.
Figure 21:
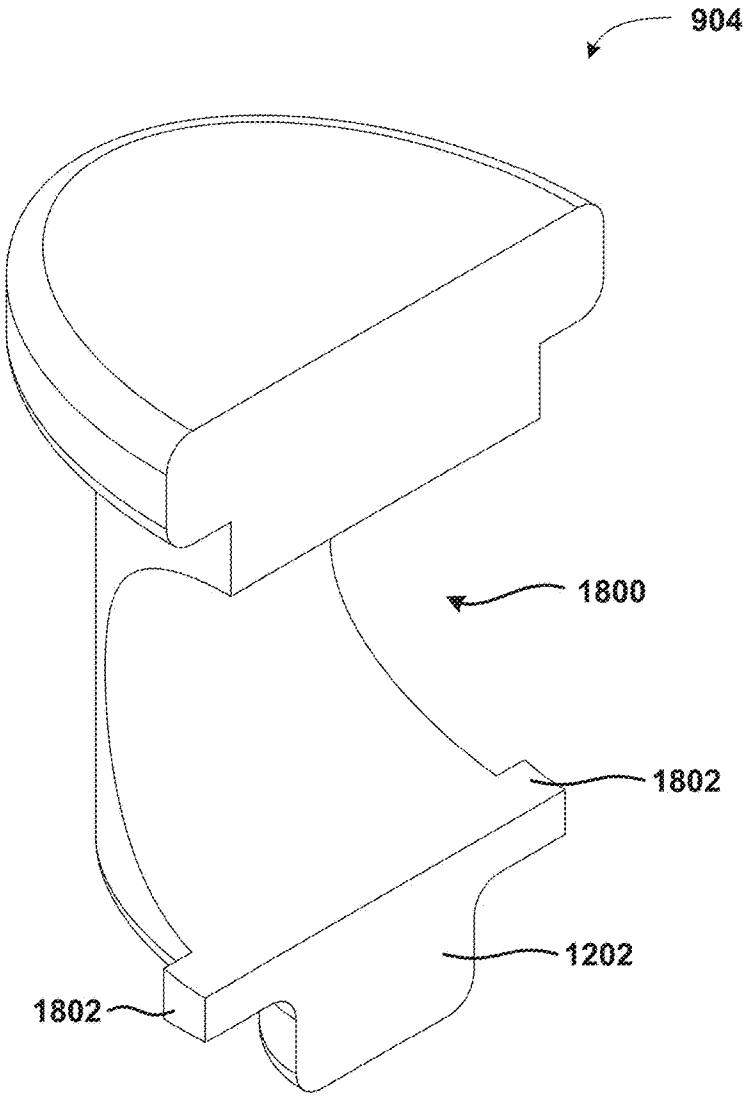

Turning now to FIGS. 21-22, additional aspects of the earpod holder 802 will be illustrated and described in additional detail. In particular, FIGS. 21-22 are line drawings that illustrate cutaway perspective views of the button portion 904 of the earpod holder 802. In FIGS. 21-22, the button spring retainer 1104 and the button retention slots 1802 are visible, as is the button aperture 1800. It should be understood that the illustrated embodiment is illustrative, and therefore should not be construed as being limiting in any way.

Figure 23:
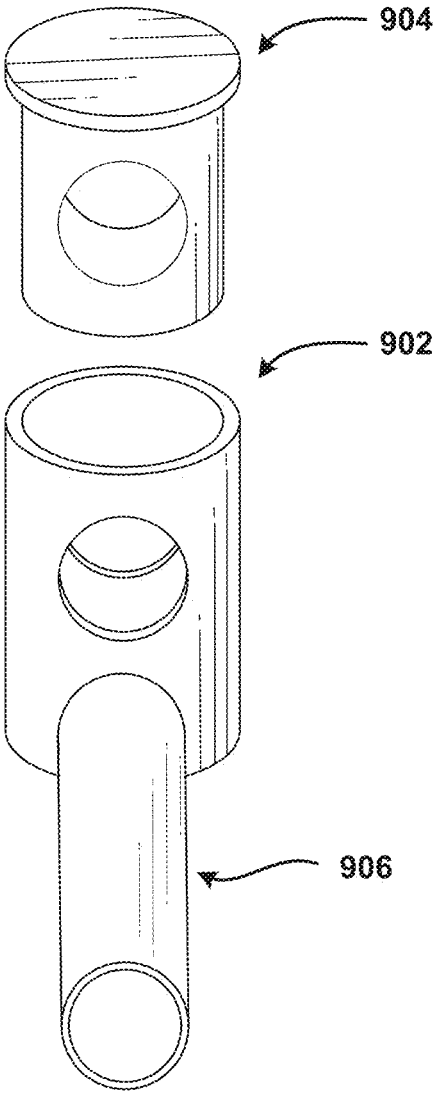
FIG. 23 is a line drawing that illustrates a perspective view of an earpod holder, according to another illustrative embodiment of the concepts and technologies disclosed herein.

Turning now to FIGS. 23-26, various views of some other contemplated embodiments of the earpod holder 802 will be illustrated and described, according to various embodiments of the concepts and technologies disclosed herein. As can be seen in FIG. 23, while the embodiment of the earpod holder 802 illustrated and described with reference to FIGS. 9-22 can be described as having an elliptical shape (e.g., the shape of a cross-section of the button portion 904 and/or the sidewalls 1200 can be described as being elliptical, this is not the case in all embodiments.

Figure 24:
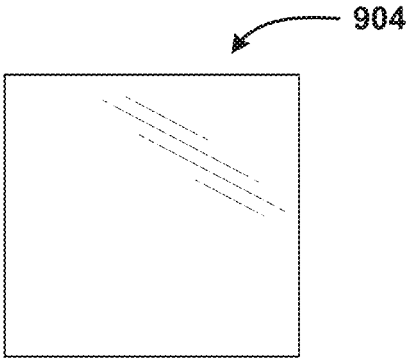
FIGS. 24-26 are line drawing showing top plan views of the button portion of earpod holders, according to some other illustrative embodiments of the concepts and technologies disclosed herein.
Figure 25:
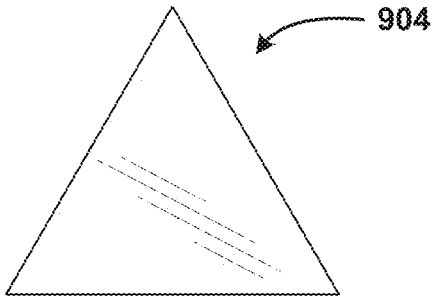
Figure 26:
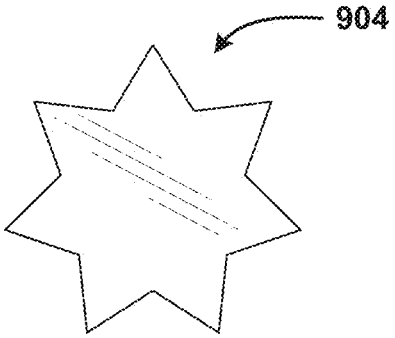

Various embodiments of the earpod holder 802 are contemplated including, but not limited to, embodiments having a substantially round cross-sectional shape (e.g., as shown in FIG. 23); a square or rectangular cross-sectional shape (e.g., as shown in FIG. 24), a triangular or polygonal cross-sectional shape (e.g., as shown in FIG. 25), a star-shaped cross-sectional shape (e.g., as shown in FIG. 26), and/or other shapes. In some contemplated embodiments, the body portion 902 of the earpod holder 802 can be substantially spherical. Because the shape of the body portion 902 and the button portion 904, among other components of the earpod holder 802, can include other shapes, it should be understood that these examples are illustrative, and therefore should not be construed as being limiting in any way.

While the above description has illustrated specific embodiments of the concepts and technologies disclosed herein, it should be understood that additional embodiments are contemplated and are possible. For example, one contemplated embodiment of the concepts and technologies disclosed herein can include an earpod holder 2700 such as that shown in FIG. 27. The earpod holder 2700 shown in FIG. 27 can include a body 2702. The body 2702 can, in some embodiments, be provided by a single piece of material of various shapes, configurations, and/or dimensions and an attachment mechanism 2704 can be disposed at one surface of the body 2702.

Figure 27:
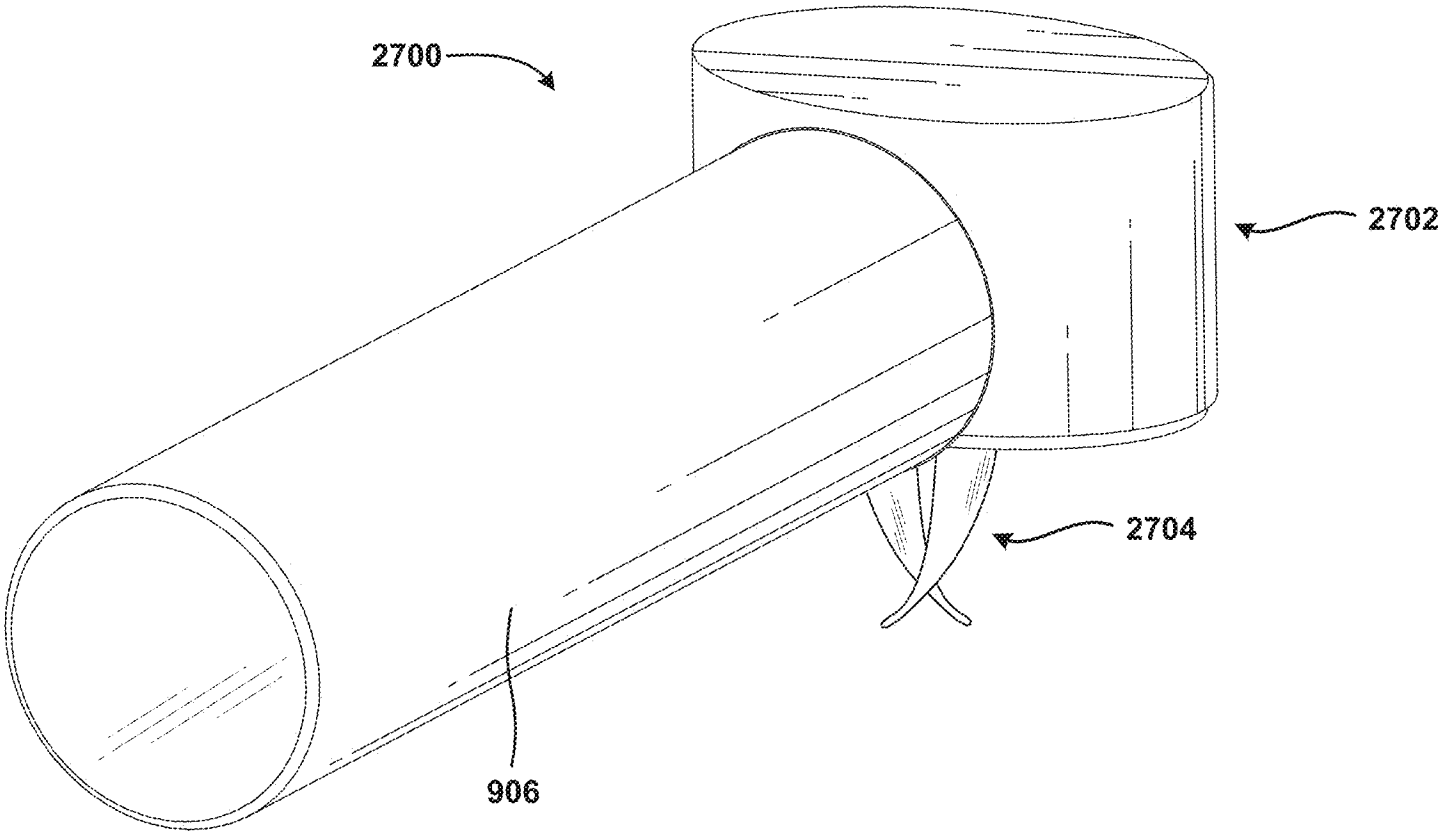
FIG. 27 is a line drawing that illustrates a perspective view of an earpod holder, according to another illustrative embodiment of the concepts and technologies disclosed herein.

In the illustrated embodiment, the body 2702 is shown as having no passageways or apertures, and the attachment mechanism 2704 is illustrated as a spring-loaded clamp (the spring is not visible in FIG. 27). It should be understood that the attachment mechanism can be provided by various structures and/or devices that can be used to connect the earpod holder 2700 to a garment, a drawstring of a garment, a collar of the garment, or the like.

Example embodiments of the attachment mechanism 2704 include a clamp, an elastic band (e.g., that can be stretched, passed around a drawstring or other structure, and released to attach the earpod holder 2700 to the drawstring or other structure), a clamp (e.g., a ring or rings of material (e.g., similar to a tube hose clamp) that can be tightened or adjusted to clamp onto a drawstring or other structure), a loop (e.g., through a string or thread can be tied), combinations thereof, or the like. Because other methods of attaching the earpod holder 2700 to a garment or component thereof are possible and are contemplated, it should be understood that these examples are illustrative, and therefore should not be construed as being limiting in any way.

Based on the foregoing, it can be appreciated that configurable garments and earpod holders have been disclosed herein. Although the subject matter presented herein has been described with respect to various structural features and/or methodological and transformative acts for forming the configurable garment and/or the various features thereof, it is to be understood that the concepts and technologies disclosed herein are not necessarily limited to the specific features or acts described herein. Rather, the specific features and acts are disclosed as example forms of implementing the concepts and technologies disclosed herein and features of a particular embodiment can be combined and/or interchanged with features of other embodiments illustrated and described herein, although such embodiments my not be separately illustrated and described herein.

The subject matter described above is provided by way of illustration only and should not be construed as limiting. Various modifications and changes may be made to the subject matter described herein without following the example embodiments and applications illustrated and described, and without departing from the true spirit and scope of the embodiments of the concepts and technologies disclosed herein.

The invention claimed is:

1. An earpod holder comprising:

a button portion having a button surface and a button spring retainer located at a first end of the button portion, wherein the button surface is located at a second end of the button portion and is connected to a button guide surface, and wherein the button guide surface comprises a button aperture that passes through the button guide surface and a button retention slot formed on the button guide surface;

a body portion having sidewalls and a body spring retainer, wherein the sidewalls surround a body portion void that is configured to accept the button guide surface, wherein the body spring retainer is located within the body portion void, and wherein the body portion comprises a front body aperture that passes through a front side of the sidewalls and into the body portion void and a rear body aperture that passes through a rear side of the sidewalls and into the body portion void;

a sleeve retainer formed on an outer surface of the sidewalls of the body portion, wherein the sleeve retainer is configured to engage and retain a sleeve that is configured to hold an earpod; and a spring, wherein a first end of the spring is connected to the button spring retainer and a second end of the spring is connected to the body spring retainer.

2. The earpod holder of claim 1, wherein the front body aperture comprises a first button retention cutout that is configured to accommodate the button retention slot.

3. The earpod holder of claim 2, further comprising another button retention slot formed on the button guide surface.

4. The earpod holder of claim 3, wherein the rear body aperture comprises a second button retention cutout, wherein the button retention slot engages the first button retention cutout, and wherein the other button retention slot engages the second button retention cutout.

5. The earpod holder of claim 1, wherein the front body aperture, the rear body aperture, and the button aperture are configured to cooperate when aligned to form a passageway.

6. The earpod holder of claim 5, wherein the passageway is configured to accommodate and engage a drawstring of a garment.

7. The earpod holder of claim 1, wherein the button portion further comprises a sidewall engagement surface that is configured to engage the sidewalls when pressure is applied to the button surface.

8. An earpod holder comprising:

a button portion having a button surface that is connected to a button guide surface, wherein the button guide surface comprises a button aperture that passes through the button guide surface and a button retention slot formed on the button guide surface;

a body portion having sidewalls that surround a body portion void that is configured to accept the button guide surface, wherein the body portion comprises a front body aperture that passes through a front side of the sidewalls and into the body portion void and a rear body aperture that passes through a rear side of the sidewalls and into the body portion void, wherein the front body aperture comprises a first button retention cutout that is configured to accommodate the button retention slot;

a sleeve comprising a cylindrical tube of material; and a sleeve retainer formed on an outer surface of the sidewalls of the body portion, wherein the sleeve retainer is configured to engage the sleeve.

9. The earpod holder of claim 8, wherein the button portion includes a button spring retainer at a first end of the button portion, and wherein the button surface is located at a second end of the button surface.

10. The earpod holder of claim 8, wherein the body portion includes a body spring retainer located within the body portion void.

11. The earpod holder of claim 8, further comprising a spring, wherein the button portion includes a button spring retainer at a first end of the button portion, wherein the button surface is located at a second end of the button portion, wherein the body portion includes a body spring retainer located within the body portion void, and wherein the spring is connected to the button spring retainer and the body spring retainer.

12. The earpod holder of claim 8, wherein the front body aperture, the rear body aperture, and the button aperture are configured to cooperate when aligned to form a passageway, and wherein the passageway is configured to accommodate and engage a drawstring.

13. The earpod holder of claim 12, further comprising another button retention slot formed on the button guide surface, wherein the rear body aperture comprises a second button retention cutout, wherein the button retention slot engages the first button retention cutout, and wherein the other button retention slot engages the second button retention cutout.

14. The earpod holder of claim 8, wherein the button portion further comprises a sidewall engagement surface that is configured to engage the sidewalls when pressure is applied to the button surface.

15. An earpod holder comprising:

a button portion having a button spring retainer and a button surface that is connected to a button guide surface, wherein the button guide surface comprises a button aperture that passes through the button guide surface and a button retention slot formed on the button guide surface;

a body portion having a body spring retainer and sidewalls that surround a body portion void that is configured to accept the button guide surface, wherein the body spring retainer is located within the body portion void, and wherein the body portion comprises a front body aperture that passes through a front side of the sidewalls and into the body portion void and a rear body aperture that passes through a rear side of the sidewalls and into the body portion void;

a spring that is connected to the button portion and the body portion, wherein a first end of the spring is connected to the button spring retainer and a second end of the spring is connected to the body spring retainer;

a sleeve comprising a cylindrical tube of material; and a sleeve retainer formed on an outer surface of the sidewalls of the body portion, wherein the sleeve retainer is configured to engage the sleeve.

16. The earpod holder of claim 15, wherein the button spring retainer is located at a first end of the button portion, and wherein the button surface is located at a second end of the button portion.

17. The earpod holder of claim 15, wherein the front body aperture comprises a first button retention cutout that is configured to accommodate the button retention slot.

18. The earpod holder of claim 17, further comprising another button retention slot formed on the button guide surface, wherein the rear body aperture comprises a second button retention cutout, wherein the button retention slot engages the first button retention cutout, and wherein the other button retention slot engages the second button retention cutout.

19. The earpod holder of claim 15, wherein the front body aperture, the rear body aperture, and the button aperture are configured to cooperate when aligned to form a passageway.

20. The earpod holder of claim 19, wherein the passageway is configured to accommodate and engage a drawstring of a garment.

* * * * *